US005462847A

United States Patent [19]

Otani

[11] Patent Number: 5,462,847

[45] Date of Patent: Oct. 31, 1995

[54] SILVER HALIDE COLOR PHOTOGRAPHIC MATERIAL

[75] Inventor: Shigeaki Otani, Kanagawa, Japan

[73] Assignee: Fuji Photo Film Co., Ltd., Kanagawa, Japan

[21] Appl. No.: 70,294

[22] Filed: Jun. 2, 1993

[30] Foreign Application Priority Data

Jun. 2, 1992 [JP] Japan ..... 4-165481

[51] Int. Cl.[6] ..... G03C 1/08

[52] U.S. Cl. ..... 430/508; 430/384; 430/385; 430/558; 430/567; 430/570; 430/576; 430/585; 430/587; 430/588; 430/590

[58] Field of Search ..... 430/558, 384, 430/385, 585, 587, 588, 590, 576, 570, 567, 508

[56] References Cited

U.S. PATENT DOCUMENTS

| | | | |
|---|---|---|---|
| 4,950,585 | 8/1990 | Tachibana et al. | 430/385 |
| 5,057,402 | 10/1991 | Shiba et al. | 430/377 |
| 5,091,297 | 2/1992 | Fukunaga et al. | 430/558 |
| 5,164,289 | 11/1992 | Shimada et al. | 430/384 |
| 5,176,993 | 1/1993 | Ohshima | 430/584 |
| 5,206,130 | 4/1993 | Shimada et al. | 430/558 |
| 5,215,871 | 6/1993 | Sato et al. | 430/384 |
| 5,256,526 | 10/1993 | Suzuki et al. | 430/384 |
| 5,270,153 | 12/1993 | Suzuki et al. | 430/384 |

FOREIGN PATENT DOCUMENTS

| | | |
|---|---|---|
| 0313021 | 4/1989 | European Pat. Off. . |
| 0488248 | 6/1992 | European Pat. Off. . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

A silver halide color photographic material is provided comprising at least one yellow-developable silver halide emulsion layer, at least one magenta-developable silver halide emulsion layer and at least one cyan-developable silver halide emulsion layer on a support, characterized in that said at least one cyan-developable silver halide emulsion layer comprises at least one cyan dye-forming coupler represented by the following general formula (Ia) and silver bromochloride or silver chloride emulsion grains substantially free of silver iodide having a silver chloride content of 95 mol % or more spectrally sensitized with at least one sensitizing dye having a reduction potential of −1.27 V (vs. SCE) or lower:

wherein Za represents —NH— or —CH($R_3$)—; Zb and Zc each represents —C($R_4$)= or —N=; $R_1$, $R_2$ and $R_3$ each represents an electron withdrawing group having a Hammett's substituent constant $\sigma_p$ value of 0.20 or more, with the proviso that the sum of $\sigma_p$ of $R_1$ and $R_2$ is 0.65 or more; $R_4$ represents a hydrogen atom or substituent, with the proviso that if two $R_4$'s are present in the general formula, they may be the same or different; X represents a hydrogen atom or a split-off group from the rest of the structure upon coupling reaction with an oxidation product of an aromatic primary amine color developing agent; and $R_1$, $R_2$, $R_3$, $R_4$ or X may be a divalent group which is connected to a dimer or higher polymer or a high molecular chain to form a homopolymer or copolymer.

The silver halide emulsion to be incorporated in said cyan-developable silver halide emulsion layer is gold-sensitized.

26 Claims, No Drawings

SILVER HALIDE COLOR PHOTOGRAPHIC MATERIAL

FIELD OF THE INVENTION

The present invention relates to a silver halide color photographic material. More particularly, the present invention relates to a silver halide color photographic material which has an excellent capability of being rapidly processed, exhibits a small sensitivity change with the fluctuations of the temperature upon exposure (dependence on the exposure temperature) and a small change in sensitivity and gradation with time after the preparation of coating solution.

BACKGROUND OF THE INVENTION

At present, photographic light-sensitive materials comprising a silver halide emulsion are utilized for various purposes in the market. The market scale has recently grown.

In this situation, photographic light-sensitive materials for use in a market that has a strong need for rapid delivery of a large amount of finished prints, such as photographic light-sensitive materials for color print in particular, requires an enhancement of the development speed which directly leads to an enhancement of print productivity. Thus, many studies have been made on the enhancement of development speed.

It has been known to increase the silver chloride content in the silver halide emulsion for the purpose of shortening the development time. The use of an emulsion having a high silver chloride content is described in JP-A-60-19140 (The term "JP-A" as used herein means an "unexamined published Japanese patent application"). In fact, the market shows a rapidly growing tendency to use a silver halide emulsion having a higher silver chloride content for color photographic paper.

However, the use of a high silver chloride emulsion has a great disadvantage in that it causes a great sensitivity change with the exposure temperature change, yielding great difficulty in supplying stably finished color prints to customers.

The relationship between the spectral sensitivity of a high silver chloride emulsion and the reduction potential of a spectral sensitizing dye used therefor is reported in "Photographic Science and Engineering", vol. 18, pp. 475–485, 1974, and "The Journal of Photographic Science", vol. 21, pp. 180–186, 1973. However, these articles do not refer to the relationship between the dependence of a high silver content emulsion on the exposure temperature and the reduction potential of a sensitizing dye used therefor.

Further, JP-A-2-42 discloses that the use of a sensitizing dye having a specified reduction potential improves the dependence of a high silver chloride content emulsion on the exposure temperature. However, the inventors found that the use of such a sensitizing dye causes a change in sensitivity and gradation with time after the preparation of a coating solution and before the coating thereof, and further improvements are needed to supply color photographic papers with stable properties to photofinishing laboratories.

SUMMARY OF THE INVENTION

As mentioned above, the present market has a strong demand for color photographic light-sensitive materials which can be rapidly processed and stably finished. It is therefore an object of the present invention to provide a silver halide color photographic material which has an excellent capability of being rapidly processed, exhibits a small change due to the fluctuations of the temperature upon exposure (dependence on the exposure temperature) and a small change in sensitivity and gradation with time after the preparation of coating solutions.

The aforementioned object of the present invention will become more apparent from the following detailed description and examples.

As a result of extensive studies, the inventors found that the aforementioned object of the present invention can be accomplished with a silver halide color photographic material comprising at least one yellow-developable silver halide emulsion layer, at least one magenta-developable silver halide emulsion layer and at least one cyan-developable silver halide emulsion layer on a support, characterized in that said at least one cyan-developable silver halide emulsion layer comprises at least one cyan dye-forming coupler represented by the following general formula (Ia) and silver bromochloride or silver chloride emulsion grains substantially free of silver iodide having a silver chloride content of 95 mol % or more, spectrally sensitized with at least one sensitizing dye having a reduction potential of −1.27 V (vs. SCE) or lower:

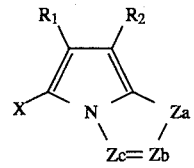

(Ia)

wherein Za represents —NH— or —CH($R_3$); Zb and Zc each represents —C($R_4$)= or —N=; $R_1$, $R_2$ and $R_3$ each represents an electron withdrawing group having a Hammett's substituent constant $\sigma_p$ value of 0.20 or more, with the proviso that the sum of $\sigma_p$ of $R_1$ and $R_2$ is 0.65 or more; $R_4$ represents a hydrogen atom or substituent, with the proviso that if two $R_4$'s are present in the general formula, they may be the same or different; X represents a hydrogen atom or a split-off group from the rest of the structure upon coupling reaction with an oxidation product of an aromatic primary amine color developing agent; and $R_1$, $R_2$, $R_3$, $R_4$ or X may be a divalent group which is connected to a dimer or higher polymer or a high molecular chain to form a homopolymer or copolymer.

Further, the at least one sensitizing dye to be used in the cyan-developable silver halide emulsion layer is selected from the group consisting of red-sensitive sensitizing dyes represented by the general formulae (A), (B), (C) and (D):

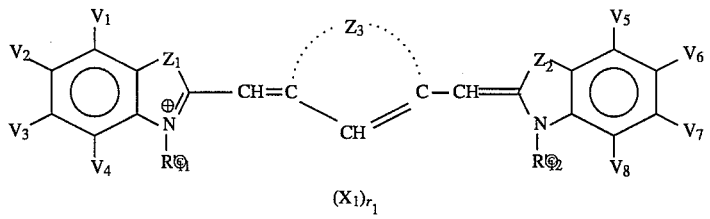

(A)

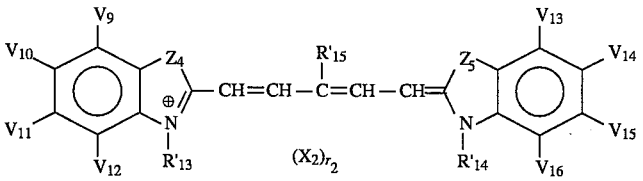

(B)

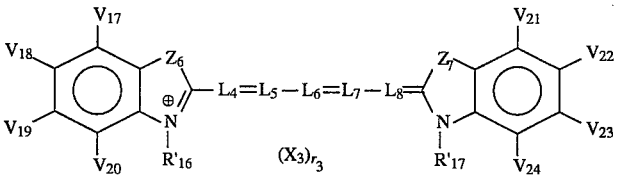

(C)

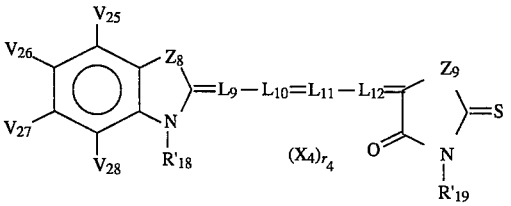

(D)

wherein $Z_1$, $Z_2$, $Z_4$ and $Z_5$ each represents a sulfur atom or selenium atom; $Z_6$ and $Z_7$ each represents an oxygen atom, sulfur atom, selenium atom or R—N in which R has the same meaning as $R'_{19}$ defined below, with the proviso that at least one of $Z_6$ and $Z_7$ represents an oxygen atom or R—N; $Z_8$ represents an oxygen atom, sulfur atom, selenium atom or R'—N in which R' has the same meaning as $R'_{19}$; $Z_9$ represents an oxygen atom, sulfur atom or R'—N in which R" has the same meaning as $R'_{19}$; $Z_3$ represents an atomic group necessary for the formation of a 5- or 6-membered ring; $R'_{11}$, $R'_{12}$, $R'_{13}$, $R'_{14}$, $R'_{16}$, $R'_{17}$ and $R'_{18}$, which may be the same or different, each represents an alkyl group; $R'_{16}$ and $L_4$, and/or $R'_{17}$ and $L_8$, and/or $R'_{18}$ and $L_9$ may be connected to each other to form a 5- or 6-membered carbon ring; $R'_{19}$ represents an alkyl group, aryl group or heterocyclic group; $R'_{15}$ represents an alkyl group or alkoxy group; $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$, $V_{22}$, $V_{23}$, $V_{24}$, $V_{25}$, $V_{26}$, $V_{27}$ and $V_{28}$ each represents a hydrogen atom, halogen atom, alkyl group, acyl group, acyloxy group, alkoxycarbonyl group, carbamoyl group, sulfamoyl group, carboxyl group, cyano group, hydroxyl group, amino group, acylamino group, alkoxy group, alkylthio group, alkylsulfonyl group, sulfonic group, aryloxy group or aryl group; two of $V_{17}$ to $V_{28}$ which are connected to adjacent carbon atoms may together form a condensed ring, with the proviso that, assuming that $Y_1=\sigma p_1+\sigma p_2+\sigma p_3+\sigma p_4+\sigma p_5+\sigma p_6+\sigma p_7+\sigma p_8$ wherein $\sigma p_i$ (i=1 to 8) is the Hammett's substituent constant value of $V_1$ to $V_8$, $Y_1$ is −0.15 or less and that, assuming that $Y_2=\sigma p_9+\sigma p_{10}+\sigma p_{11}+\sigma p_{12}+\sigma p_{13}+\sigma p_{14}+\sigma p_{15}+\sigma p_{16}$ wherein $\sigma p_i$ (i=9 to 16) is the Hammett's substituent constant value of $V_9$ to $V_{16}$, $Y_2$ is −0.30 or less; $L_4$, $L_5$, $L_6$, $L_7$, $L_8$, $L_9$, $L_{10}$, $L_{11}$ and $L_{12}$ each represents a methine group; two of these methine groups may together form a ring; $(X_1)_{r1}$, $(X_2)_{r2}$, $(X_3)_{r3}$ and $(X_4)_{r4}$ each represents a charge balanced paired ion; and $r_1$, $r_2$, $r_3$ and $r_4$ each represents a value necessary for the neutralization of charge of 0 or more.

Moreover, the silver halide emulsion to be incorporated in the cyan-developable silver halide emulsion layer is gold-sensitized.

DETAILED DESCRIPTION OF THE INVENTION

The present invention will be further described hereinafter.

Specific examples of the cyan coupler of the present invention represented by the general formula (Ia) include those represented by the following general formulae (IIa) to (VIIIa):

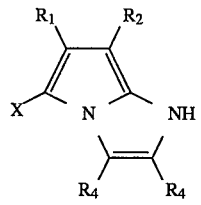

(IIa)

-continued (IIIa)

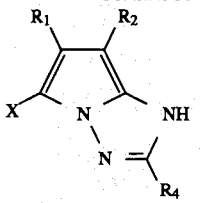

(IVa)

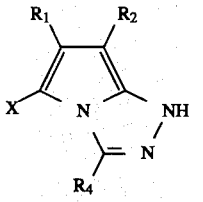

(Va)

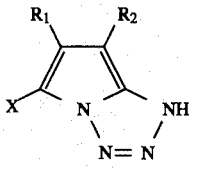

(VIa)

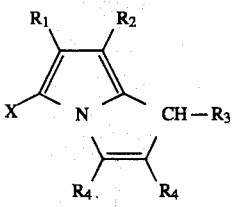

(VIIa)

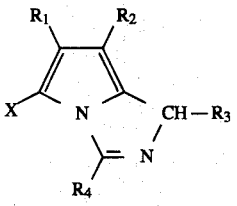

(VIIIa)

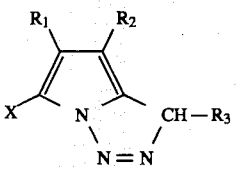

wherein $R_1$, $R_2$, $R_3$, $R_4$ and X are as defined in the general formula (Ia).

Preferred among these cyan couplers are those represented by the general formulae (IIa), (IIIa) and (IVa), particularly (IIIa).

In the cyan coupler of the present invention, $R_1$, $R_2$ and $R_3$ each is an electron withdrawing group having a Hammett's substituent constant σp of 0.20 or more, with the proviso that the sum of σp of $R_1$ and $R_2$ is 0.65 or more, preferably 0.70 or more and not more than 1.8.

$R_1$, $R_2$ and $R_3$ each is an electron withdrawing group having a Hammett's substituent constant σp of 0.20 or more, preferably 0.35 or more, more preferably 0.60 or more, and not more than 1.0. Hammett's rule is an empirical law which was proposed in 1935 by L. P. Hammtt to give a quantative discussion of the effect of substituents on the reaction or equilibrium of benzene derivatives. This rule is now widely considered reasonable. Substituent constants determined by Hammett's rule include $\sigma_p$ value and $\sigma_m$ value which can be found in many general references, e.g., J. A. Dean, "Lange's Handbook of Chemistry", vol. 12, 1979 (McGraw-Hill), and "kagaku no Ryoiki (The Domain of Chemistry)", extra edition, No. 122, pp. 96–103, 1979 (Nankodo). In the present invention, $R_1$, $R_2$ and $R_3$ are defined by Hammett's substituent constant $\sigma_p$. However, this does not mean that these substituents are limited to those having known $\sigma_p$ values found in the above cited references. It goes without saying that even these substituents exhibit $\sigma_p$ values unknown in any reference, they are included in those having $\sigma_p$ values that would be included in the range known in these references when measured according to Hammett's rule.

Specific examples of $R_1$, $R_2$ and $R_3$ having a σp value of 0.20 or more include acyl group, acyloxy group, carbamoyl group, alkoxycarbonyl group, aryloxycarbonyl group, cyano group, nitro group, dialkylphosphono group, diarylphosphono group, diarylphosphinyl group, alkylsulfinyl group, arylsulfinyl group, alkylsulfonyl group, arylsulfonyl group, sulfonyloxy group, acylthio group, sulfamoyl group, thiocyanate group, thiocarbonyl group, halogenated alkyl group, halogenated alkoxy group, halogenated aryloxy group, halogenated alkylamino group, halogenated alkylthio group, aryl group substituted by other electron withdrawing groups having a σp value of 0.20 or more, heterocyclic group substituted by other electron withdrawing groups having a σp value of 0.20 or more, halogen atom, azo group, and selenocyanate group, the groups each having 1 to 35 carbon atoms. Among these substituents, those which can further contain substituents may further contain substituents described hereinafter with reference to $R_4$.

Further referring to $R_1$, $R_2$ and $R_3$, the electron withdrawing group having a σp value of 0.20 or more include acyl group (e.g., acetyl, 3-phenylpropanoyl, benzoyl, 4-dodecyloxybenzoyl), acyloxy group (e.g., acetoxy), carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamide)phenylcarbamoyl, N-methyl-N-dodecylcarbamoyl, N-[3-(2,4-di-t-amylphenoxy)-propyl}carbamoyl), alkoxycarbonyl group (e.g., methoxycarbonyl, ethoxycarbonyl, iso-propyloxycarbonyl, tert-butyloxycarbonyl, iso-butyloxycarbonyl, butyloxycarbonyl, dodecyloxycarbonyl, octadecyloxycarbonyl, diethylcarbamoylethoxycarbonyl, perfluorohexylethoxycar-bonyl, 2-decyl-hexyloxycarbonylmethoxycarbonyl), aryloxycarbonyl group (e.g., phenoxycarbonyl, 2,5-amylphenoxycarbonyl), cyano group, nitro group, dialkylphosphono group (e.g., dimethylphosphono), diarylphosphono group (e.g., diphenylphosphono), dialkoxyphosphoryl group (e.g., dimethoxyphosphoryl), diarylphosphinyl group (e.g., diphenylphosphinyl), alkylsulfinyl group (e.g., 3-phenoxypropylsulfinyl), arylsulfinyl group (e.g., 3-pentadecylphenylsulfinyl), alkylsulfonyl group (e.g., methanesulfonyl, octanesulfonyl), arylsulfonyl group (e.g., benzenesulfonyl, toluenesulfonyl), sulfonyloxy group (e.g., methanesulfonyloxy, toluenesulfonyloxy), acylthio group (e.g., acetylthio, benzoylthio), sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), thiocyanate group, thiocarbonyl group (e.g., methylthiocarbonyl, phenylthiocarbonyl), halogenated alkyl group (e.g., trifluoromethyl, heptafluoropropyl), halogenated alkoxy group (e.g., trifluoromethyloxy), halogenated aryloxy group (e.g., pentafluorophenyloxy), halogenated alkylamino group (e.g., N,N-di-(trifluoromethyl)amino), halogenated alkylthio group (e.g., difluoromethylthio, 1,1,2,2-tetrafluoroethylthio), aryl group substituted by other electron withdrawing group having a σp value of 0.20 or more (e.g., 2,4-dinitrophenyl, 2,4,6-trichlorophenyl, pentachlorophenyl), heterocyclic group (e.g., 2-benzoxazolyl, 2-benzothiazolyl, 1-phenyl-2-benzimidazolyl, pyrazolyl, 5-chloro-1-tetrazolyl, 1-pyrrolyl), halogen atom (e.g., chlorine, bromine), azo group (e.g., phenylazo), and selenocyanate group.

Typical examples of σp value of electron withdrawing group include 0.66 for cyano group, 0.78 for nitro group, 0.54 for trifluoromethyl group, 0.50 for acetyl group, 0.92 for trifluoromethanesulfonyl group, 0.72 for methanesulfonyl group, 0.70 for benzenesulfonyl group, 0.49 for methanesulfinyl group, 0.36 for carbamoyl group, 0.45 for methoxycarbonyl group, 0.37 for pyrazolyl group, 0.36 for methanesulfonyloxy group, 0.60 for dimethoxyphosphoryl group, and 0.57 for sulfamoyl group.

Preferred examples of $R_1$, $R_2$ and $R_3$ include acyl group, acyloxy group, carbamoyl group, alkoxycarbonyl group, aryloxycarbonyl group, cyano group, nitro group, alkylsulfinyl group, arylsulfinyl group, alkylsulfonyl group, arylsulfonyl group, sulfamoyl group, halogenated alkyl group, halogenated alkyloxy group, halogenated alkylthio group, halogenated aryloxy group, halogenated aryl group, and aryl group substituted by two or more nitro groups and heterocyclic group substituted by two or more nitro groups. Preferred among these groups are acyl group, alkoxycarbonyl group, aryloxycarbonyl group, nitro group, cyano group, arylsulfonyl group, carbamoyl group, and halogenated alkyl group. More preferred among these groups are cyano group, alkoxycarbonyl group, aryloxycarbonyl group, and halogenated alkyl group.

Particularly preferred are a cyano group, a trifluoromethyl group, a straight-chain or branched unsubstituted alkoxycarbonyl group, an alkoxycarbonyl group substituted with a carbamoyl group, an alkoxycarbonyl group having an ether bond, or an aryloxycarbonyl group that is either unsubstituted or substituted with an alkyl group or an alkoxy group.

The combination of $R_1$ and $R_2$ is preferably that $R_1$ is a cyano group and $R_2$ is any of a trifluoromethyl group, a straight-chain or branched unsubstituted alkoxycarbonyl group, an alkoxycarbonyl group substituted with a carbamoyl group, an alkoxycarbonyl group having an ether bond, and an aryloxycarbonyl group that is either unsubstituted or substituted with an alkyl group or an alkoxy group.

$R_4$ represents a hydrogen atom or substituent (including atom). Examples of such a substituent include halogen atom, aliphatic group, aryl group, heterocyclic group, alkoxy group, aryloxy group, heterocyclic oxy group, alkylthio group, arylthio group, heterocyclic thio group, acyloxy group, carbamoyloxy group, silyloxy group, sulfonyloxy group, acylamino group, alkylamino group, arylamino group, ureido group, sulfamoylamino group, alkenyloxy group, formyl group, alkylacyl group, arylacyl group, heterocyclic acyl group, alkylsulfonyl group, arylsulfonyl group, heterocyclic sulfonyl group, alkylsulfinyl group, arylsulfinyl group, heterocyclic sulfinyl group, alkyloxycarbonyl group, aryloxycarbonyl group, heterocyclic oxycarbonyl group, alkyloxycarbonylamino group, aryloxycarbonylamino group, heterocyclic oxycarbonylamino group, sulfonamide group, carbamoyl group, sulfamoyl group, phosphonyl group, sulfamide group, imido group, azolyl group, hydroxyl group, cyano group, carboxyl group, nitro group, sulfo group, and unsubstituted amino group. Among these groups, alkyl group, aryl group or heterocyclic group may be further substituted by substituents described with reference to $R_4$.

Specific examples of $R_4$ include hydrogen atom, halogen atom (e.g., chlorine, bromine), aliphatic group (e.g., $C_{1-36}$ straight-chain or branched alkyl group, aralkyl group, alkenyl group, alkinyl group, cycloalkyl group, cycloalkenyl group, such as methyl, ethyl, propyl, isopropyl, t-butyl, tridecyl, 2-methanesulfonylethyl, 3-(3-pentadecylphenoxy)propyl, 3-{4-{2-(4-hydroxyphenylsulfonyl)phenoxy] dodecanamido}phenyl} propyl, 2-ethoxytridecyl, trifluoromethyl, cyclopentyl, 3-(2,4-di-t-amylphenoxy)propyl), aryl group (e.g., $C_{6-36}$ aryl group, such as phenyl, naphthyl, 4-hexadecyloxyphenyl, 4-t-butylphenyl, 2,4-di-t-amylphenyl, 4-tetradecanamidophenyl, 3-(2,4-tert-amylphenoxyacetamido)phenyl), heterocyclic group (e.g., 3-pyridyl, 2-furyl, 2-thienyl, 2-pyridyl, 2-pyrimidinyl, 2-benzothiazolyl), alkoxy group (e.g., methoxy, ethoxy, 2-methoxyethoxy, 2-dodecyloxyethoxy, 2-methanesulfonylethoxy), aryloxy group (e.g., phenoxy, 2-methylphenoxy, 4-tert-butylphenoxy, 2,4-di-tert-amylphenoxy, 2-chlorophenoxy, 4-cyanophenoxy, 3-nitrophenoxy, 3-t-butyloxycarbamoylphenoxy, 3-methoxycarbamoylphenoxy), heterocyclic oxy group (e.g., 2-benzimidazolyloxy, 1-phenyltetrazole-5-oxy, 2-tetrahydropyranyloxy), alkylthio group, arylthio group or heterocyclic thio group (e.g., methylthio, ethylthio, octylthio, tetradecylthio, 2-phenoxyethylthio, 3-phenoxypropylthio, 3-(4-tert-butylphenoxy)propylthio, phenylthio, 2-butoxy-5-tert-octylphenylthio, 3-pentadecylphenylthio, 2-carboxyphenylthio, 4-tetradecanamidophenylthio, 2-benzothiazolylthio, 2,4-di-phenoxy-1,3,4-triazole-6-thio, 2-pyridylthio), acyloxy group (e.g., acetoxy, hexadecanoyloxy), carbamoyloxy group (e.g., N-ethylcarbamoyloxy, N-phenylcarbamoyloxy), silyloxy group (e.g., trimethylsilyloxy, dibutylmethylsilyloxy), sulfonyloxy group (e.g., dodecylsulfonyloxy), acylamino group (e.g., acetamide, benzamide, tetradecanamide, 2-(2,4-tert-amylphenoxy)acetamide, 2-[4-(4-hydroxyphenylsulfonyl)phenoxy)]decanamide, isopentadecanamide, 2-(2,4-di-t-amylphenoxy)butanamide, 4-(3-t-butyl-4-hydroxyphenoxy)butanamide), alkylamino group (e.g., methylamino, butylamino, dodecylamino, dimethylamino, diethylamino, methylbutylamino), arylamino group (e.g., phenylamino, 2-chloroanilino, 2-chloro-5-tetradecanamidanilino, N-acetylanilino, 2-chloro-5-[α-2-tert-butyl-4-hydroxyphenoxy)dodecanamide]-anilino, 2-chloro-5-dodecyloxycarbonylanilino), ureido group (e.g., methylureido, phenylureido, N,N-dibutylureido, dimethylureido), sulfamoylamino group (e.g., N,N-dipropylsulfamoylamino, N-methyl-N-decylsulfamoylamino), alkenyloxy group (e.g., 2-propenyloxy), formyl group, alkylacyl group, arylacyl group or heterocyclic acyl group (e.g., acetyl, benzoyl, 2,4-di-tert-amyl-phenylacetyl, 3-phenylpropanoyl, 4-dodecyloxybenzoyl), alkylsulfonyl group, arylsulfonyl group or heterocyclic sulfonyl group (e.g., methanesulfonyl, octanesulfonyl, benzenesulfonyl, toluenesulfonyl), alkylsulfinyl group, arylsulfinyl group or heterocyclic sulfinyl group (e.g., octanesulfinyl, dodecanesulfinyl phenylsulfinyl, 3-pentadecylphenylsulfinyl, 3-phenoxypropylsulfinyl), alkyloxycarbonyl group, aryloxycarbonyl group or heterocyclic oxycarbonyl group (e.g., methoxycarbonyl, butoxycarbonyl, dodecyloxycarbonyl, octadecyloxycarbonyl, phenyloxycarbonyl, 2-pentadecyloxycarbonyl), alkyloxycarbonylamino group, aryloxycarbonylamino group or heterocyclic oxycarbonylamino group (e.g., methoxycarbonylamino, tetradecyloxycarbonylamino, phenoxycarbonylamino, 2,4-di-tert-butylphenoxycarbonylamino), sulfonamide group (e.g., methanesulfonamide, hexadecanesulfonamide, benzenesulfonamide, p-toluenesulfonamide, octadecanesulfonamide, 2-methoxy-5-tert-butylbenzenesulfonamide), carbamoyl group (e.g., N-ethylcarbamoyl, N,N-dibutylcarbamoyl, N-(2-dodecyloxyethyl)carbamoyl, N-methyl-N-dodecylcarbamoyl, N-[3-(2,4-di-tert-amyl-phenoxy)propyl]carbamoyl), sulfamoyl group (e.g., N-ethylsulfamoyl, N,N-dipropylsulfamoyl, N-(2-dodeyloxyethyl)sulfamoyl, N-ethyl-N-dodecylsulfamoyl, N,N-diethylsulfamoyl), phosphonyl group (e.g., phenoxyphosphonyl, octyloxyphosphonyl, phenylphosphonyl), sulfamido group (e.g., dipropylsulfamoylamino), imido group (e.g., N-succinimido, hydantoinyl, N-phthalimido, 3-octadecenylsuccinimido), azolyl group (e.g., imidazolyl, pyrazolyl, 3-chloro-pyrazole-1-yl, triazolyl), hydroxy group, cyano group, carboxy group, nitro group, sulfo group, and unsubstituted amino group.

Preferred among these groups represented by $R_4$ are alkyl group, aryl group, heterocyclic group, cyano group, nitro group, acylamino group, arylamino group, ureido group, sulfamoylamino group, alkylthio group, arylthio group, heterocyclic thio group, alkoxycarbonylamino group, aryloxycarbonylamino group, sulfonamido group, carbamoyl group, sulfamoyl group, sulfonyl group, alkoxycarbonyl group, aryloxycarbonyl group, heterocyclic oxy group, acyloxy group, carbamoyloxy group, imido group, sulfinyl group, phosphonyl group, acyl group, and azolyl group.

More preferred among these groups are alkyl group, and aryl group. Further preferred among these groups are alkyl group or aryl group containing at least one alkoxy, sulfonyl, sulfamoyl, carbamoyl, acylamido or sulfonamido group as a substituent. Particularly preferred among these groups are alkyl group or aryl group containing at least one acylamido or sulfonamido group as a substituent.

In the general formula (Ia), X represents a hydrogen atom or a group which is separated from the rest of the molecule when the coupler reacts with an oxidation product of an aromatic primary amine color developing agent (hereinafter referred to as "split-off group"). The split-off group represented by X is a halogen atom; aromatic azo group; alkyl, aryl, heterocyclic, alkylsulfonyl, arylsulfonyl, arylsulfinyl, alkoxycarbonyl, aryloxycarbonyl, heterocyclic oxycarbonyl, alkylcarbonyl, arylcarbonyl, heterocyclic carbonyl, alkylaminocarbonyl, arylaminocarbonyl or heterocyclic aminocarbonyl group connected to the coupling position via oxygen, nitrogen, sulfur or carbon atom; or heterocyclic group connected to the coupling position via a nitrogen atom contained therein. Examples of such split-off groups include halogen atom, alkoxy group, aryloxy group, acyloxy group, alkylsulfonyloxy group, arylsulfonyloxy group, acylamino group, alkylsulfonamide group, arylsulfonamide group, alkoxycarbonyloxy group, aryloxycarbonyloxy group, alkylthio group, arylthio group, heterocyclic thio group, carbamoylamino group, arylsulfinyl group, arylsulfonyl group, 5- or 6-membered nitrogen-containing heterocyclic group, imido group, and arylazo group. Among these split-off groups, the alkyl group, aryl group or heterocyclic group may be further substituted by substituents described with reference to $R_4$. When two or more of such substituents are present, they may be the same or different. These substituents may be further substituted by substituents described with reference to $R_4$.

Specific examples of these split-off groups include halogen atom (e.g., fluorine, chlorine, bromine), alkoxy group (e.g., ethoxy, dodecyloxy, methoxyethyl carbamoylmethoxy, carboxypropyloxy, methylsulfonylethoxy, ethoxycarbonylmethoxy), aryloxy group (e.g., 4-methylphenoxy, 4-chlorophenoxy, 4-methoxyphenoxy, 4-carboxyphenoxy, 3-ethoxycarboxylphenoxy, 3-acetylaminophenoxy, 2-carboxyphenoxy), acyloxy group (e.g., acetoxy, tetradecanoyloxy, benzoyloxy), alkylsulfonyloxy group or arylsulfonyloxy group (e.g., methanesulfonyloxy, toluenesulfonyloxy), acylamino group (e.g., dichloroacetylamino, heptafluorobutyrylamino), alkylsulfonamido group or arylsulfonamido group (e.g., methanesulfonamino, trifluoromethanesulfonamino, p-toluenesulfonylamino), alkoxycarbonyloxy group (e.g., ethoxycarbonyloxy, benzyloxycarbonyloxy), aryloxycarbonyloxy group (e.g., phenoxycarbonyloxy), alkylthio group, arylthio group or heterocyclic thio group (e.g., ethylthio, 2-carboxyethylthio, dodecylthio, 1-carboxydodecylthio, phenylthio, 2-butoxy-5-t-octylphenylthio, tetrazolylthio), arylsulfonyl group (e.g., 2-butoxy-5-tert-octylphenylsulfonyl), arylsulfinyl group (e.g., 2-butoxy-5-tert-octylphenylsulfinyl), carbamoylamino group (e.g., N-methylcarbamoylamino, N-phenylcarbamoylamino), 5- or 6-membered nitrogen-containing heterocyclic group (e.g., imidazolyl, pyrazolyl, triazolyl, tetrazolyl, 1,2-dihydro-2-oxo-1-pyridyl), imido group (e.g., succinimido, hydantoinyl), and arylazo group (e.g., phenylazo, 4-methoxyphenylazo). Of course, these groups may be further substituted by substituents described with reference to $R_4$. As the split-off group connected to the rest of the molecule via a carbon atom there may be used a bis-type coupler obtained by condensing a four-equivalent coupler with aldehyde or ketone. The split-off group of the present invention may contain photographically useful groups such as development inhibitors and development accelerators.

Preferred examples of the group represented by X include halogen atom, alkoxy group, aryloxy group, alkylthio group, arylthio group, arylsulfonyl group, arylsulfinyl group, and 5- or 6-membered nitrogen-containing heterocyclic group connected to the coupling active position via a nitrogen atom. Preferred among these groups is arylthio group.

In the cyan coupler represented by the general formula (Ia), $R_1$, $R_2$, $R_3$, $R_4$ or X may contain a cyan coupler residue represented by the general formula (Ia) to form a dimer or higher polymer, or $R_1$, $R_2$, $R_3$, $R_4$ or X may contain a high molecular chain to form a homopolymer or copolymer. A typical example of the homopolymer or copolymer containing a high molecular chain is a homopolymer or copolymer of addition polymer ethylenically unsaturated compounds containing a cyan coupler residue represented by the general formula (Ia). Such a polymer may contain one or more kinds of cyan-coloring repeating units containing a cyan coupler residue represented by the general formula (Ia). Such a polymer may also be a copolymer containing one or more kinds of noncoloring ethylenic monomers which don't undergo coupling with an oxidation product of an aromatic primary amine developing agent such as acrylic ester, methacrylic ester and maleic ester.

Specific examples of the coupler of the present invention will be given below, but the present invention should not be construed as being limited thereto.

(1)
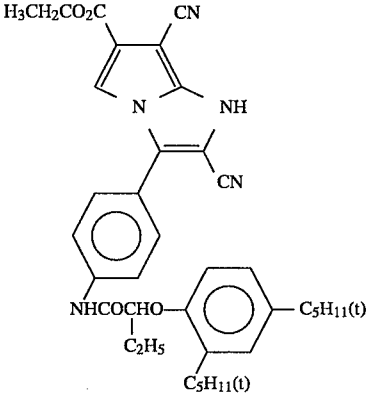
(2)
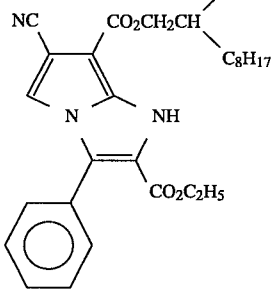

-continued
(3)
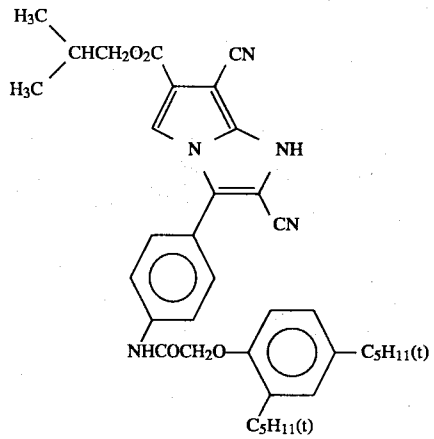
(4)
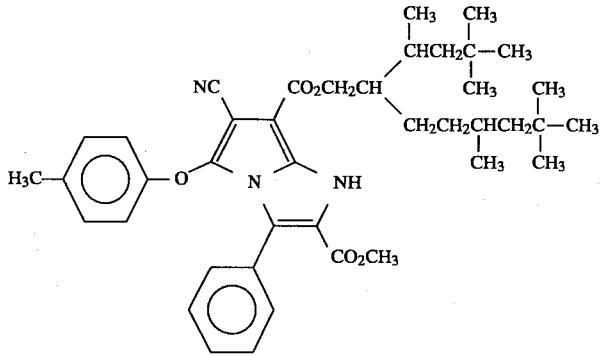

-continued
(5)
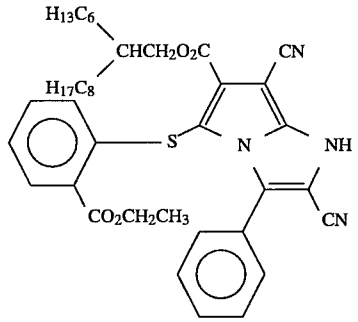
(6)
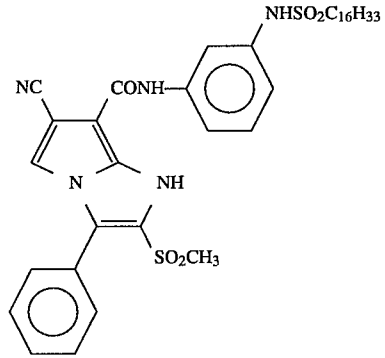
(7)
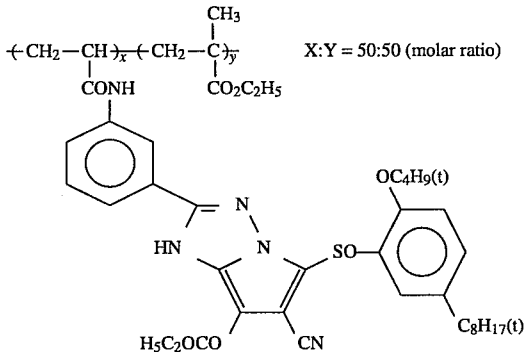

-continued
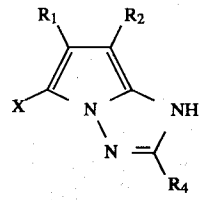
| No. | $R_1$ | $R_2$ | $R_4$ | X |
|---|---|---|---|---|
| 8 | $CO_2CH_3$ | CN | 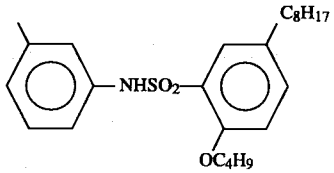 | H |
| 9 | CN | 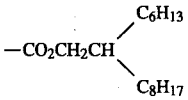 | 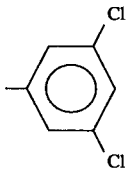 | H |
| 10 | CN | 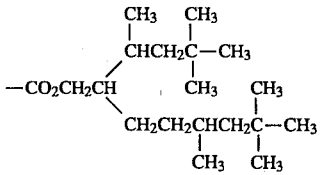 | 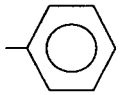 | H |
| 11 | CN | 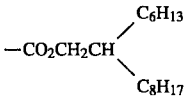 | 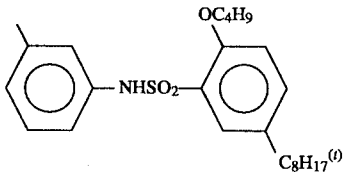 | H |

-continued
| | | | | |
|---|---|---|---|---|
| 12 | CN | 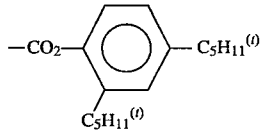 | 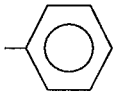 | H |
| 13 | CN | 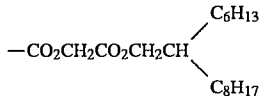 | 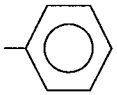 | H |
| 14 | CN | $-CO_2CH_2CH_2(CF_2)_6F$ | 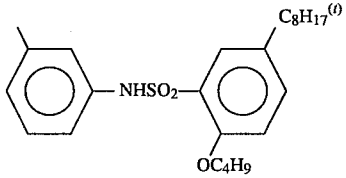 | H |
| 15 | CN | 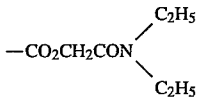 | 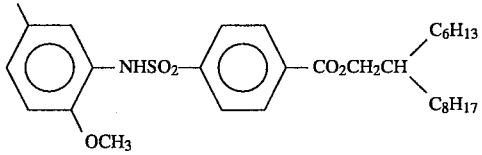 | 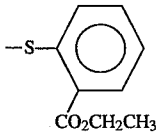 |
| 16 | CN | $-CO_2CH_2CH_2(CF_2)_6F$ | 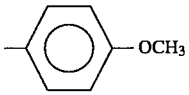 | 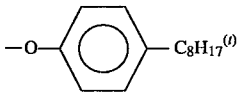 |
| 17 | CN | 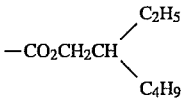 | 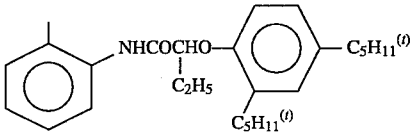 | 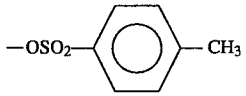 |
| 18 | CN | 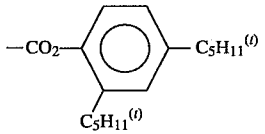 | 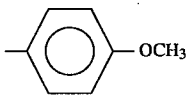 | 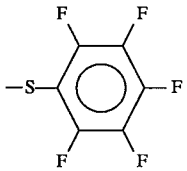 |

-continued
| | | | | |
|---|---|---|---|---|
| 19 | CN | $-CO_2CH_2CH(CH_3)_2$ | 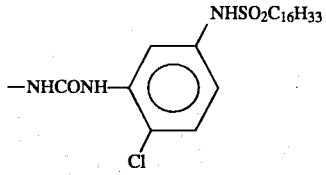 | 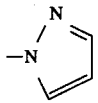 |
| 20 | CN | $-CO_2CH_2(CF_2)_4H$ | 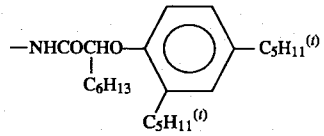 | 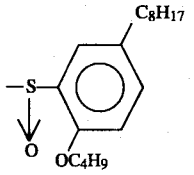 |
| 21 | CN | $-CO_2CH_2CH(C_8H_{17})(C_6H_{13})$ | 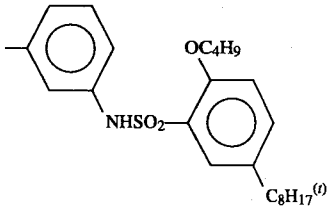 | H |
| 22 | 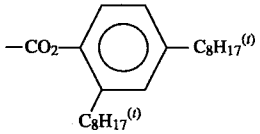 | CN | 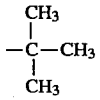 | 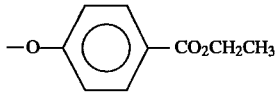 |
| 23 | $-CO_2CH_2C_6F_{13}$ | CN | 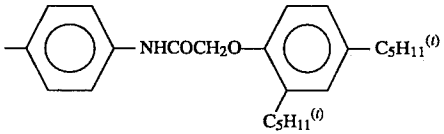 | Cl |
| 24 | 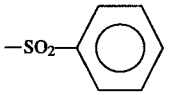 | 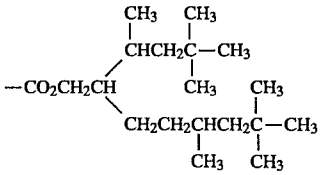 | $CH_3$ | $-OCOCH_3$ |

-continued
| | | | | |
|---|---|---|---|---|
| 25 | CN | $-CO_2CH_2CO_2CH_3$ | 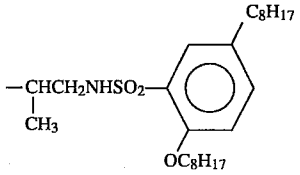 | 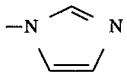 |
| 26 | CN | 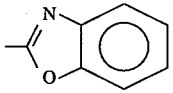 | 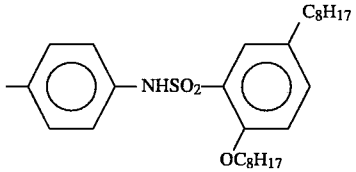 | 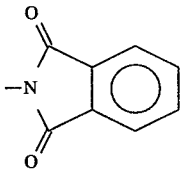 |
| 27 | CN | $CF_3$ | 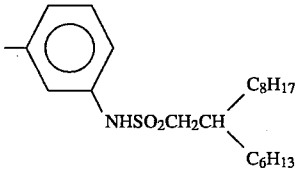 | Cl |
| 28 | 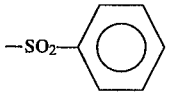 | $CF_3$ | 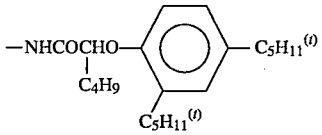 | F |
| 29 | CN | 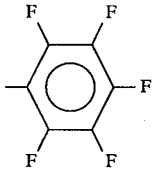 | 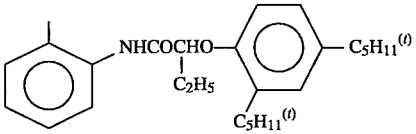 | 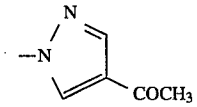 |
| 30 | 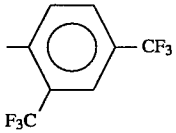 | 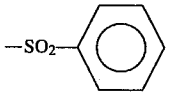 | 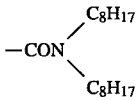 | 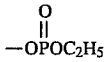 |

-continued
| | | | | |
|---|---|---|---|---|
| 31 | CN | 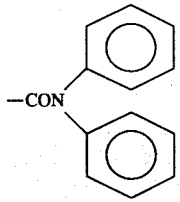 | 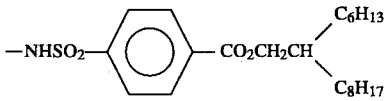 | 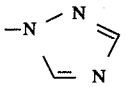 |
| 32 | CN | 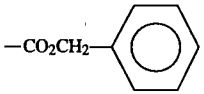 | 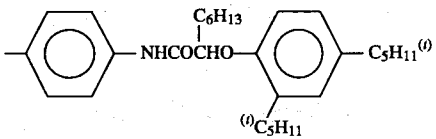 | H |
| 33 | CN | 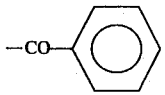 | 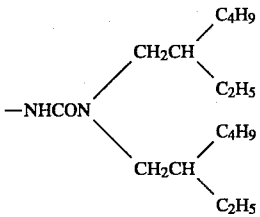 | $-OSO_2CH_3$ |
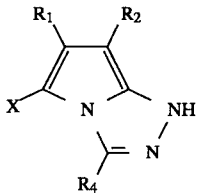
| No. | $R_1$ | $R_2$ | $R_4$ | X |
|---|---|---|---|---|
| 34 | $-CO_2C_2H_5$ | CN | 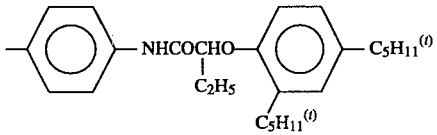 | Cl |

-continued
| | | | | | |
|---|---|---|---|---|---|
| 35 | CN | 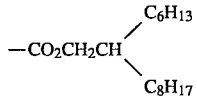 | 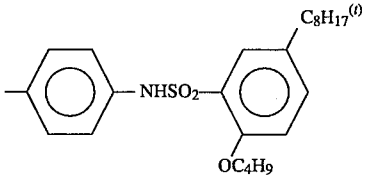 | H | |
| 36 | CN | $-CO_2CH_2CH_2(CF_2)_6F$ | 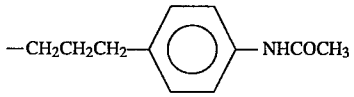 | 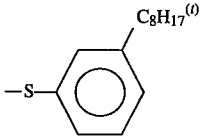 | 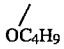 |
| 37 | CN | 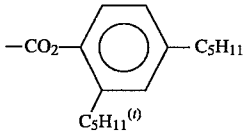 | 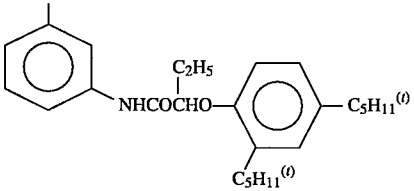 | 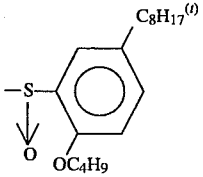 | |
| 38 | CN | 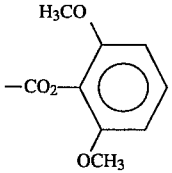 | 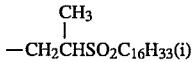 | 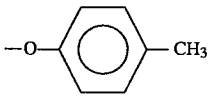 | |
| 39 | CN | 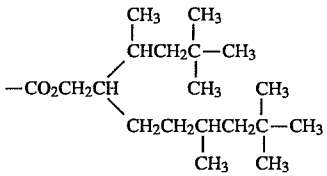 | 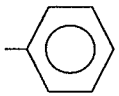 | H | |

-continued
| | | | | |
|---|---|---|---|---|
| 40 | CN | $-CO_2CH(CH_3)_2$ | 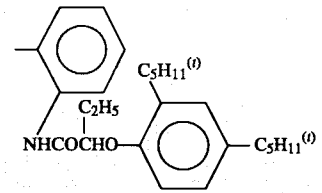 | Cl |
| 41 | CN | $-CON(C_2H_5)_2$ | 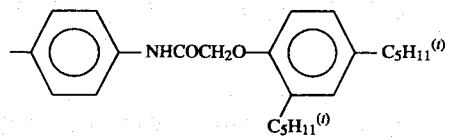 | $-OSO_2CH_3$ |
(42)
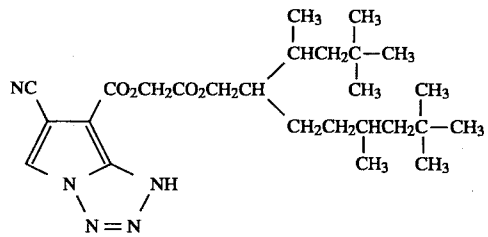
(43)
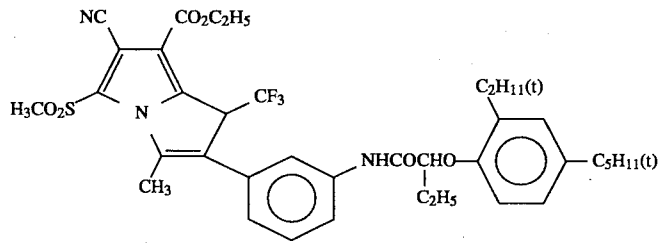

-continued
(44)
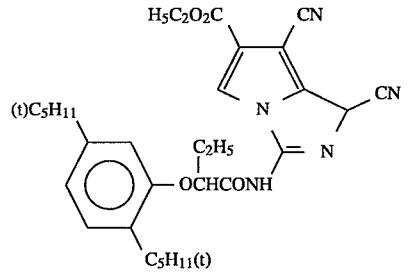
(45)
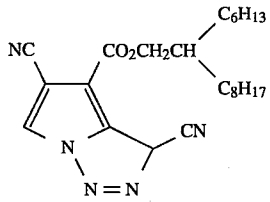
(46)
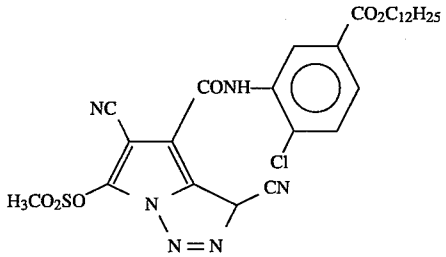

The compound of the present invention and intermediates thereof can be synthesized by known methods. For example, methods described in J. Am. Chem. Soc., No. 80, 5332 (1958), J.A,. Chem. Soc., No. 81, 2452 (1959), J.A,. Chem. Soc., No. 112, 2465 (1990), Org. Synth., I, 270 (1941), J. Chem. Soc., 5149 (1962), Heterocycles, No. 27, 2301 (1988), Rec. Tray. chim., 80, 1075 (1961), articles cited therein, or analogous methods can be used.

Specific examples of such synthesis methods will be given below.

SYNTHESIS EXAMPLE 1

Synthesis of Exemplary Compound (9)

Exemplary Compound (9) was synthesized in accordance with the following reaction formula:

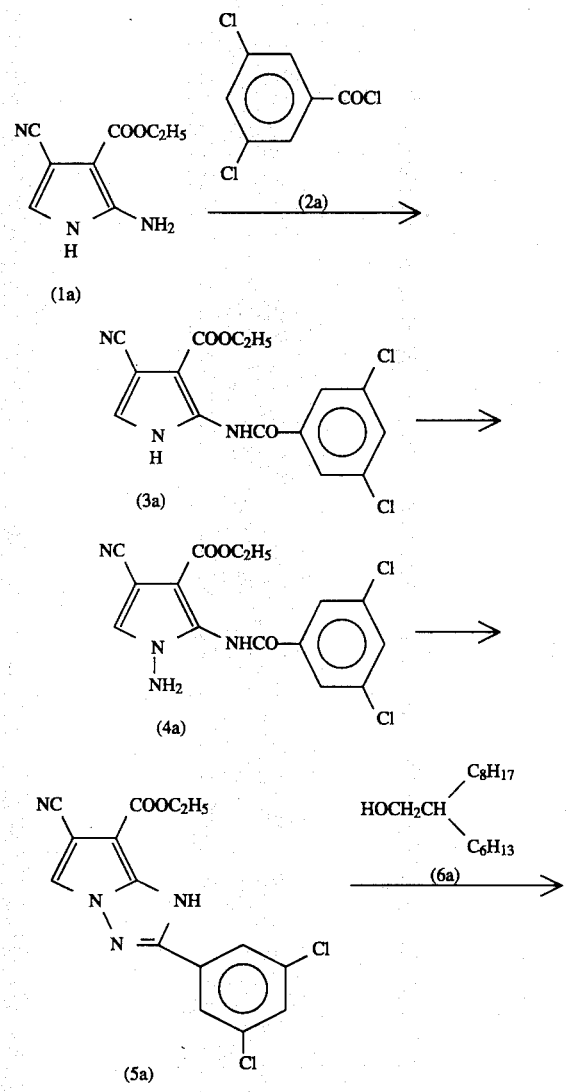

-continued

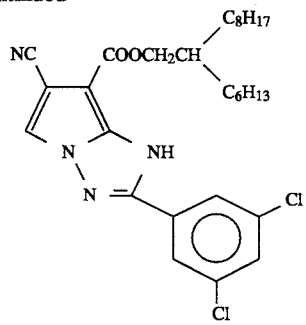

Exemplary Coupler (9)

To a solution of 66.0 g (0.4 mol) of 2-amino-4-cyano-3-methoxycarbonylpyrrole (1*a*) in 300 ml of dimethylacetamide was added 83.2 g (0.4 mol) of 3,5-dichlorobenzoyl chloride at room temperature. The admixture was stirred for 30 minutes. Water was added to the material. The material was extracted with ethyl acetate twice. The resulting organic phase was recovered, washed with water and saturated brine, and then dried with sodium sulfate anhydride. The solvent was distilled off under reduced pressure. The residue was then recrystallized from 300 ml of acetonitrile to obtain 113 g (yield: 84%) of Compound (3*a*).

To a solution of 101.1 g (0.3 mol) of Compound (3*a*) in 200 ml of dimethylformamide was added 252 g (4.5 mol) of potassium hydroxide powder at room temperature with vigrous stirring. Under cooling with water, 237 g (2.1 mol) of hydroxylamine-o-sulfonic acid was gradually added to the material in such a manner that the temperature of the system didn't show a steep rise. After the addition, the material was stirred for 30 minutes. A 0.1N aqueous solution of hydrochloric acid was then added dropwise to the material until the material was inspected on a pH testing paper to be neutralized. The material was extracted with ethyl acetate three times. The resulting organic phase was washed with water and saturated brine, and then dried with anhydrous sodium sulfate. Under reduced pressure, the solvent was distilled off. The residue was then purified through column chromatography (developing solvent: 2:1 mixture of hexane and ethyl acetate) to obtain 9.50 g (yield: 9%) of Compound (4*a*).

To a solution of 7.04 g (20 mmol) of Compound (4*a*) in 30 ml of acetonitrile was added 9 cc of carbon tetrachloride. To the material was then added 5.76 g (22 mmol) of triphenylphosphine. The material was then heated under reflux for 8 hours. After cooling, the material was extracted with ethyl acetate three times. The resulting organic phase was washed with water and saturated brine, and then dried with anhydrous sodium sulfate. Under reduced pressure, the solvent was distilled off. The residue was purified through silica gel column chormatography (developing solvent: 4:1 mixture of hexane and ethyl acetate) to obtain 1.13 g (yield: 17%) of Compound (5*a*).

1.8 g of Compound (5a) thus obtained and 12.4 g of Compound (6*a*) were dissolved in 2.0 ml of sulfolane. To the solution was added 1.5 g of titanium isopropoxide. The material was then allowed to undergo reaction at a temperature kept to 110° C. for 1.5 hours. To the material was added ethyl acetate. The material was then washed with water. The ethyl acetate phase was dried. The solvent was distilled off.

The residue was then purified through column chromatography to obtain 1.6 g of Exemplary Compound (9) as the desired compound.

The melting point of the compound was 97° C. to 98° C.

If the cyan coupler of the present invention represented by the general formula (Ia) is applied to a silver halide color photographic material, at least one layer containing the coupler of the present invention may be present on a support. The layer containing the coupler of the present invention may be a hydrophilic colloidal layer on the support. In a general color photographic light-sensitive material, at least one blue-sensitive silver halide emulsion layer, one blue-sensitive silver halide emulsion layer and one red-sensitive silver halide emulsion layer may be coated on a support in this order or different orders. Alternatively, an infrared-sensitive silver halide emulsion layer may be used instead of at least one of these light-sensitive emulsion layers. These light-sensitive emulsion layers can each comprise a silver halide emulsion sensitive to the respective wavelength range and a color coupler which forms a dye complementary to the light to which the silver halide emulsion is sensitive to provide color reproduction in subtractive color process. The light-sensitive emulsion layer and the color hue of color coupler may not have the aforementioned correspondence.

If the coupler of the present invention represented by the general formula (Ia) is applied to a photographic light-sensitive material, it is particularly preferably incorporated in a red-sensitive silver halide emulsion layer.

The amount of the coupler of the present invention to be incorporated in the photographic light-sensitive material is in the range of $1\times10^{-3}$ mol to 1 mol, preferably $2\times10^{-3}$ mol to $5\times10^{-1}$ mol per mol of silver halide.

The sensitizing dye to be incorporated in the cyan-developable silver halide emulsion layer of the present invention preferably exhibits a reduction potential of −1.29 V (vs SCE) or lower. The measurement of reduction potential was carried out by phase discrimination secondary harmonics alternating polarography. The measurement process will be further described below. As a solvent for sensitizing dye there was used acetonitrile (spectral grade) dried in 4A-1/16 Molecular Sieves (trade name, available from Wako Junyaku K.K.) with a normal tetrapropyl ammonium perchloroate (special reagent for polarography) as a supporting electrolyte. The specimen solution was prepared by dissolving a sensitizing dye in acetonitrile containing 0.1M supporting electrolyte in an amount of $10^{-3}$ to $10^{-5}$ mol/l. Before measurement, the specimen solution was deoxidized with a high purity (99.999%) argon gas which had been passed through a highly alkaline aqueous solution of pyrogallol and calcium chloride for 15 minutes or more. As a work electrode there was used a dropping mercury electrode. As a reference electrode there was used a saturated calomel electrode (SCE). As the opposite electrode there was used a platinum electrode. The reference electrode and the specimen solution were connected to each other through a rugin tube filled with acetonitrile containing 0.1M supporting electrolyte. Vycor glass was used for the liquid connecting portion. The measurement was carried out at a temperature of 25° C. with the tip of the rugin tube and the tip of mercury capillary being 5 mm to 8 mm apart. The measurement of reduction potential by phase discrimination secondary harmonics alternating voltammetry using platinum as a work electrode is described in "Journal of Imaging Science", vol. 30, pp. 27–35, 1986.

The sensitizing dye to be used in the present invention is preferably a red-sensitive sensitizing dye having a reduction potential specified above. In particular, the sensitizing dye to be used in the present invention is preferably selected from sensitizing dyes represented by the general formulae (A), (B), (C) and (D).

The sensitizing dyes represented by the general formulae (A), (B), (C) and (D) which are preferably used in the present invention will be further described hereinafter.

Preferred examples of $R'_{11}$, $R'_{12}$, $R'_{13}$, $R'_{14}$, $R'_{16}$, $R'_{17}$ and $R'_{18}$ in these general formulae include unsubstituted alkyl groups containing 18 or less carbon atoms (e.g., methyl, ethyl, propyl, butyl, pentyl, octyl, decyl, dodecyl, octadecyl), and substituted alkyl groups containing 18 or less carbon atoms {examples of such substituents include carboxy groups, sulfo groups, cyano groups, halogen atom (e.g., fluorine, chlorine, bromine), hydroxyl groups, alkoxycarbonyl groups containing 8 or less carbon atoms (e.g., methoxycarbonyl, ethoxycarbonyl, phenoxycarbonyl, benzyloxycarbonyl), alkoxy groups containing 8 or less carbon atoms (e.g., methoxy, ethoxy, benzyloxy, phenethyloxy), monocyclic aryloxy groups containing 10 or less carbon atoms (e.g., phenoxy, p-tolyloxy), acyloxy groups containing 3 or less carbon atoms (e.g., acetyloxy, propionyloxy), acyl groups containing 8 or less carbon atoms (e.g., acetyl, propionyl, benzoyl, mesyl), carbamoyl groups (e.g. , carbamoyl, N,N-dimethylcarbamoyl, morpholinocarbonyl, piperidinocarbonyl), sulfamoyl groups (e.g., sulfamoyl, N,N-dimethylsulfamoyl, morpholinosulfonyl, piperidinosulfonyl), aryl groups containing 10 or less carbon atoms (e.g., phenyl, 4-chlorophenyl, 4-methylphenyl, α-naphthyl)}.

Particularly preferred among these groups are unsubstituted alkyl groups (e.g., methyl, ethyl), and sulfoalkyl groups (e.g., 2-sulfoethyl, 3-sulfopropyl, 4-sulfobutyl).

$R'_{16}$ and $L_4$, and/or $R'_{17}$ and $L_8$, and/or $R'_{18}$ and $L_9$ may be connected to each other to form a 5- or 6-membered carbon ring.

$R'_{19}$ is preferably $C_{1-18}$, more preferably $C_{1-7}$, particularly $C_{1-4}$ alkyl group (e.g., methyl, ethyl, propyl, isopropyl, butyl, isobutyl, hexyl, octyl, dodecyl, octadecyl), substituted alkyl group {e.g., aralkyl (e.g., benzyl, 2-phenylethyl), hydroxylalkyl (e.g., 2-hydroxyethyl, 3-hydroxypropyl), carboxyalkyl (e.g., 2-carboxyethyl, 3-carboxypropyl, 4-carboxybutyl, carboxymethyl), alkoxyalkyl (e.g., 2-methoxyethyl, 2-(2-methoxyethoxy)ethyl), sulfoalkyl (e.g., 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), sulfatoalkyl (e.g., 3-sulfatopropyl, 4-sulfatobutyl), heterocyclic substituted alkyl group (e.g., 2-(pyrrolidine-2-one-1-yl)ethyl, tetrahydrofurfuryl, 2-morpholinoethyl), 2-acetoxyethyl, carbomethoxymethyl, 2-methanesulfonylaminoethyl, allyl}, aryl group (e.g., phenyl, 2-naphthyl), substituted aryl group (e.g., 4-carboxyphenyl, 4-sulfophenyl, 3-chlorophenyl, 3-methylphenyl) or heterocyclic group (e.g., 2-pyridyl, 2-thiazolyl).

Preferred examples of $R'_{15}$ include $C_{1-3}$ unsubstituted alkyl groups (e.g., methyl, ethyl, propyl), $C_{1-4}$ substituted alkyl groups {e.g., alkyl substituted by substituents such as $C_{1-2}$ alkoxy groups (e.g., methoxy, ethoxy)}, and $C_{1-3}$ alkoxy groups (e.g., methoxy, ethoxy). Preferred among these groups are methyl groups, ethyl groups, and methoxy groups. Particularly preferred among these groups are methyl groups.

$Z_3$ is preferably a 5- or 6-membered carbon ring, and more preferably 2,2-dimethyl-trimethylene.

$Z_1$, $Z_2$, $Z_4$ and $Z_5$ each represents a sulfur atom or selenium atom, preferably sulfur atom.

$Z_6$ and $Z_7$ each represents an oxygen atom, sulfur atom, selenium atom or R—N in which R has the same meaning as $R'_{19}$, with the proviso that at least one of $Z_6$ and $Z_7$ represents an oxygen atom or nitrogen atom. Preferably, $Z_6$ and $Z_7$ each represents a sulfur atom or oxygen atom, and at least one of them represents an oxygen atom.

$Z_8$ represents an oxygen atom, sulfur atom, selenium atom or R'—N in which R' has the same meaning as $R'_{19}$, preferably sulfur atom.

$Z_9$ represents an oxygen atom, sulfur atom, selenium atom or R"—N in which R" has the same meaning as $R'_{19}$, preferably sulfur atom.

$V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$, $V_{22}$, $V_{23}$, $V_{24}$, $V_{25}$, $V_{26}$, $V_{27}$, and $V_{28}$ each represents a hydrogen atom, halogen atom (e.g., chlorine, fluorine, bromine), unsubstituted alkyl group, preferably having 10 or less carbon atoms (e.g., methyl, ethyl), substituted alkyl group, preferably having 18 or less carbon atoms (e.g., benzoyl, α-naphthylmethyl, 2-phenylethyl, trifluoromethyl), acyl group, preferably having 10 or less carbon atoms (e.g., acetyl, benzoyl, mesyl), acyloxy group, preferably having 10 or less carbon atoms (e.g., acetyloxy), alkoxycarbonyl group, preferably having 10 or less carbon atoms (e.g., methoxycarbonyl, ethoxycarbonyl, benzyloxycarbonyl), substituted or unsubstituted carbamoyl group (e.g., carbamoyl, N,N-dimethylcarbamoyl, morpholinocarbonyl, piperidinocarbonyl), substituted or unsubstituted sulfamoyl group (e.g., sulfamoyl, N,N-dimethylsulfamoyl, morpholinosulfonyl, piperidinosulfonyl), carboxyl group, cyano group, hydroxyl group, amino group, acylamino group, preferably having 8 or less carbon atoms (e.g., acetylamino), alkoxy group, preferably having 10 or less carbon atoms (e.g., methoxy, ethoxy, benzyloxy), alkylthio group (e.g., ethylthio), alkylsulfonyl group (e.g., methylsulfonyl), sulfonic group, aryloxy group (e.g., phenoxy) or aryl group (e.g., phenyl, tolyl). Two of $V_{17}$ to $V_{28}$ which are connected to adjacent carbon atoms may be connected to each other to form a condensed ring. Examples of such a condensed ring include benzene ring and heterocycle (e.g., pyrrole, thiophene, furan, pyridine, imidazole, triazole, thiazole).

Assuming that $Y_1=\sigma p_1+\sigma p_2+\sigma p_3+\sigma p_4+\sigma p_5+\sigma p_6+\sigma p_7+\sigma p_8$ wherein $\sigma p_i$ (i=1 to 8) is the Hammett's substituent constant value of $V_1$ to $V_8$, $Y_1$ is −0.15 or less.

Assuming that $Y_2=\sigma p_9+\sigma p_{10}+\sigma p_{11}+\sigma p_{12}+\sigma p_{13}+\sigma p_{14}+\sigma p_{15}+\sigma p_{16}$ wherein $\sigma p_i$ (i=9 to 16) is the Hammett's substituent constant value of $V_9$ to $V_{16}$, $Y_2$ is −0.30 or less.

$Y_1$ is more preferably −0.30 or less, and $Y_2$ is more preferably −0.45 or less.

σp represents a value set forth in "Yakubutsu no Kozokassei Sokan-Drug Design to Sayokisaku Kenkyu eno Shishin(Relationship between structure and activity of chemicals)" ("Kagaku no Ryoiki(Region of Chemistry)", No. 122, Kozo Kassei Sokan Konwakaihen), pp. 96–103, Nankodo, and Corwin Hansh and Albert Leo, "Substituent Constants for Correlation Analysis in Chemistry and Biology", pp. 69–161, John Wiley and Sons. The method for the measurement of σp is described in "Chemical Reviews", vol. 17, pp. 125–136, 1935.

Preferred examples of $V_1$ to $V_{16}$ include hydrogen atoms, unsubstituted alkyl groups having 6 or less carbon atoms (e.g., methyl, ethyl, n-propyl, isopropyl, n-butyl, t-butyl, pentyl, cyclopropyl, cyclobutyl, cyclopentyl, cyclohexyl), substituted alkyl groups having 8 or less carbon atoms (e.g., carboxymethyl, 2-carboxyethyl, benzyl, phenethyl, dimethylaminopropyl), hydroxyl groups, amino groups (e.g., amino, hydroxylamino, methylamino, dimethylamino, diphenylamino), alkoxy groups (e.g., methoxy, ethoxy, isopropoxy, propoxy, butoxy, pentoxy), aryloxy groups (e.g., phenoxy), and aryl groups (e.g., phenyl).

$L_4$, $L_5$, $L_6$, $L_7$, $L_8$, $L_9$, $L_{10}$, $L_{11}$ and $L_{12}$ each represents a methine group which may be substituted by a substituted or unsubstituted alkyl group (e.g., methyl, ethyl), substituted or unsubstituted aryl group (e.g., phenyl) or a halogen atom or may form a ring with other methine groups.

$(X_1)_{r1}$, $(X_2)_{r2}$, $(X_3)_{r3}$ and $(X_4)_{r4}$ are hidden in the formulae to indicate the presence or absence of cation or anion, if necesary for the neutralization of ionic charge of dye. Accordingly, $r_1$, $r_2$, $r_3$ and $r_4$ each may have a proper value of 0 or more as necessary. Whether a dye is a cation or anion or has a net ionic charge or not depends on its auxochrome and substituents. A typical cation is an inoganic or organic ammonium ion or alkaline ion. On the other hand, a typical anion may be either an inorganic anion or organic anion. Examples of such an anion include halogen anion (e.g., fluoride ion, chloride ion, bromide ion, iodide ion), substituted arylsulfonate ion (e.g., p-toluenesulfonate ion, p-chlorobenzenesulfonate ion), aryldisulfonate ion (e.g., 1,3-benzenesulfonate ion, 1,5-naphthalenedisulfonate ion, 2,6-naphthalenedisulfonate ion), alkylsulfate ion (e.g., methylsulfate ion), sulfate ion, thiocyanate ion, perchlorate ion, tetrafluoroborate ion, pictate ion, acetate ion, and trifluoromethanesulfonate ion. Preferred among these anions is iodide ion.

Specific examples of the sensitizing dye to be used in the present invention represented by the general formulae (A), (B), (C) and (D) will be given below, but the present invention should not be construed as being limited thereto.

Exemplary Compounds (A-1) to (A-17) set forth in Table A indicate specific examples of substituents in the general formula (A) ($Z_1$ and $Z_2$ each represents S, $Z_3$ represents 2, 2-dimethyltrimethylene group, $V_1$, $V_4$, $V_5$, $V_8$ each represents hydrogen atom).

TABLE A

| No. | $R'_{11}$ | $R'_{12}$ | $V_2$ | $V_3$ | $V_6$ | $V_7$ | $X_1$ | $R_1$ | $E_R$ (V vs SCE) |
|---|---|---|---|---|---|---|---|---|---|
| A-1 | $CH_2CH_3$ | $CH_2CH_3$ | $CH_3$ | H | H | H | $I^{\ominus}$ | 1 | −1.27 |
| A-2 | " | " | $CH_3$ | $CH_3$ | H | H | " | " | −1.29 |
| A-3 | " | " | $CH_3$ | H | $CH_3$ | H | " | " | −1.29 |
| A-4 | " | " | $CH_3$ | H | H | $CH_3$ | " | " | −1.28 |
| A-5 | " | " | H | $CH_3$ | H | $CH_3$ | " | " | −1.27 |
| A-6 | " | " | $CH_3O$ | H | H | H | " | " | −1.27 |
| A-7 | " | " | H | $CH_3O$ | H | H | " | " | −1.27 |
| A-8 | " | " | $CH_3O$ | $CH_3O$ | H | H | " | " | −1.29 |
| A-9 | " | " | $CH_3O$ | H | $CH_3O$ | H | " | " | −1.30 |
| A-10 | " | " | H | $CH_3O$ | H | $CH_3O$ | " | " | −1.28 |
| A-11 | " | " | $CH_3$ | $CH_3$ | $CH_3$ | $CH_3$ | " | " | −1.33 |
| A-12 | " | " | $CH_3O$ | $CH_3O$ | $CH_3O$ | $CH_3O$ | " | " | −1.34 |

TABLE A-continued
| | | | | | | | | | |
|---|---|---|---|---|---|---|---|---|---|
| A-13 | " | " | $N(CH_3)_2$ | H | H | H | " | " | −1.28 |
| A-14 | $(CH_2)_3SO_3\ominus$ | " | $CH_3$ | H | $CH_3$ | H | — | — | −1.29 |
| A-15 | $(CH_2)_4SO_3\ominus$ | " | $CH_3$ | H | $CH_3$ | H | — | — | −1.29 |
| A-16 | $(CH_2)_3SO_3\ominus$ | $(CH_2)_3SO_3\ominus$ | $CH_3$ | H | $CH_3$ | H | $NH^{\oplus}(C_2H_5)_3$ | 1 | −1.29 |
| A-17 | $(CH_2)_4CH_3$ | $CH_2CH_3$ | $CH_3$ | H | $CH_3$ | H | $I^{\ominus}$ | 1 | −1.29 |
(A-18.)
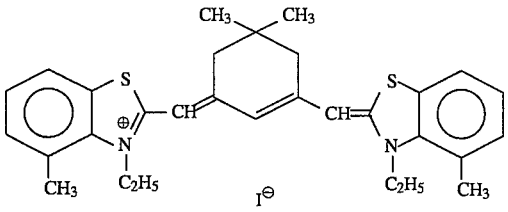
$E_R = -1.29$
(A-19.)
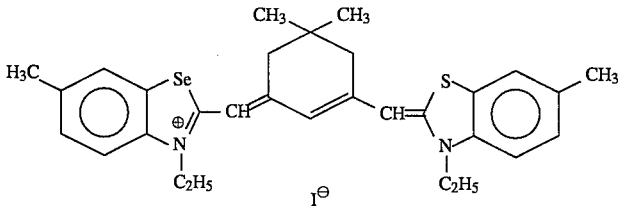
$E_R = -1.28$
(B-1)
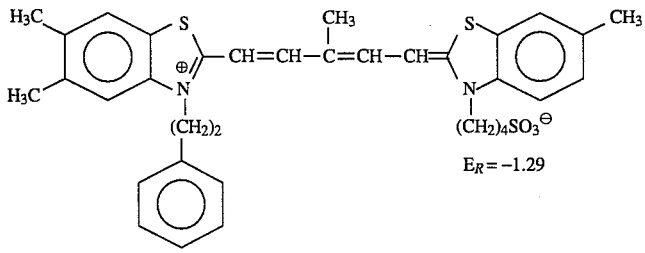
$E_R = -1.29$
(B-2)
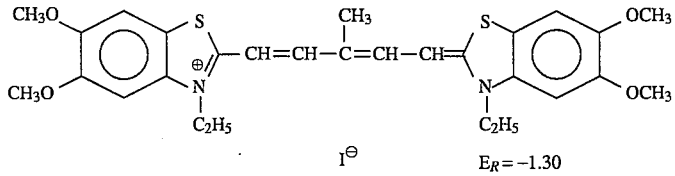
$E_R = -1.30$
(B-3)
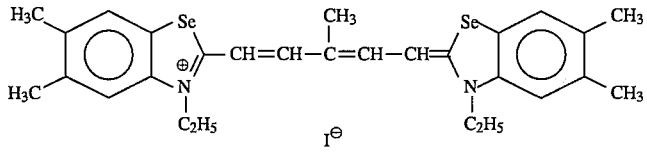
$E_R = -1.29$ TABLE A-continued
(C-1)
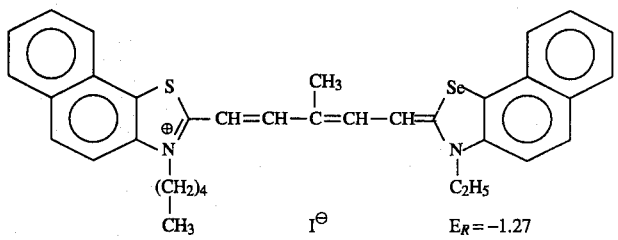
$I^{\ominus}$ $E_R = -1.27$
(C-2)
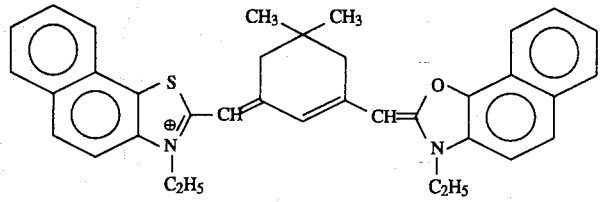
$I^{\ominus}$ $E_R = -1.33$
(C-3)
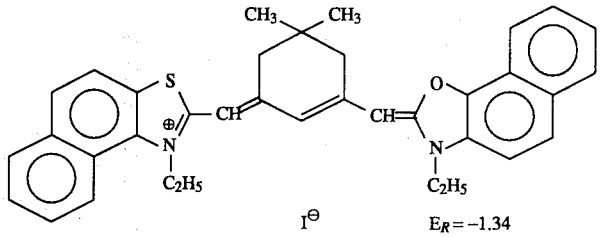
$I^{\ominus}$ $E_R = -1.34$
(C-4)
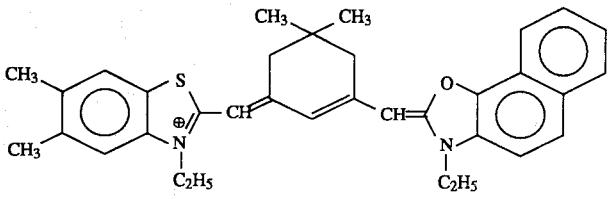
$I^{\ominus}$ $E_R = -1.34$
(C-5)
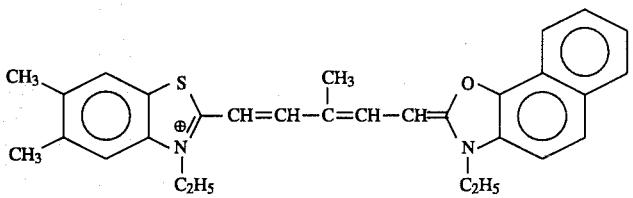
$I^{\ominus}$ $E_R = -1.28$ TABLE A-continued (D-1)

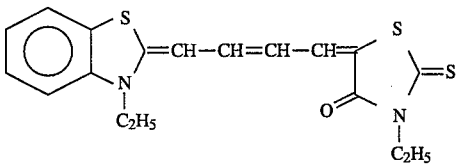

$E_R = -1.42$ (D-2)

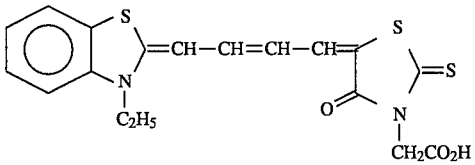

$E_R = -1.42$ (D-3)

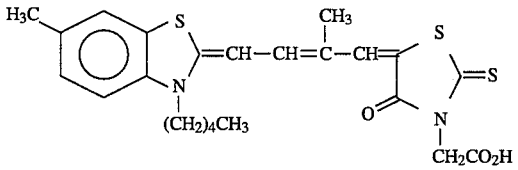

$E_R = -1.46$ (D-4)

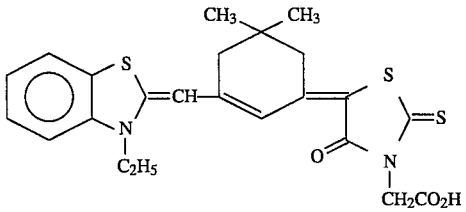

$E_R = -1.49$

The dyes represented by the general formulae (A), (B), (C) and (D) to be used in the present invention can be easily synthesized by any proper methods as disclosed in F. M. Hamer, "Heterocyclic Compounds-Cyanine Dyes and Related Compounds", Chapter IX, pp. 270–287, Chapter VII, pp. 200–243, Chapter XIV, pp. 511–611, John Wiley and Sons, 1964, D. M. Sturmer, "Heterocyclic Compounds-Special Topics in Heterocyclic Chemistry", Chapter VIII, sec. IV, pp. 482–515, John Wiley and Sons, 1977, etc.

The addition of the compound represented by the general formula (A), (B), (C) or (D) to be used in the present invention to a silver halide emulsion can be accomplished by any method well known in the art. In general, the compound of the present invention may be added to the silver halide emulsion in solution in one or an admixture of water-soluble solvents such as methanol, ethanol, pyridyl, methyl cellosolve and acetone or a mixture of such an organic solvent with water.

The compound of the present invention may be added to the silver halide emulsion at any time during the preparation thereof, preferably during the chemical ripening of the emulsion, or either before or after the addition of a stabilizer or fog inhibitor after the completion of the chemical ripening.

The added amount of the compound (A), (B), (C) or (D) to be used in the present invention is not specifically limited but is normally in the range of $1\times10^{-6}$ to $1\times10^{-3}$ mol, preferably $1\times10^{-5}$ to $5\times10^{-4}$ mol per mol of silver halide.

In the present invention, if a sensitizing dye having a spectral sensitivity particularly to a wavelength range from red to infrared is used, a compound described in JP-A-2-157749, lower right column, page 13 to lower right column, page 22 may be added. The use of such a compound can specifically enhance the preservability, processing stability and super-sensitizability of the photographic light-sensitive material. In particular, the combined use of compounds represented by the general formulae (IV), (V) and (VI) disclosed in the above cited publication is preferable. Such a compound is used in an amount of $0.5\times10^{-5}$ mol to $5.0\times10^{-2}$ mol, preferably $5.0\times10^{-5}$ mol to $1.0\times10^{-2}$ mol per mol of silver halide. The advantageous amount of such a compound to be used is from 1 to 10,000 times, preferably 2 to 5,000 times per mol of sensitizing dye.

In the color photographic light-sensitive material of the present invention, a yellow-developable silver halide emulsion layer, a magenta-developable silver halide emulsion layer, and a cyan-developable silver halide emulsion layer are coated on a support in this order.

These light-sensitive emulsion layers can each comprise a silver halide emulsion sensitive to the respective wavelength range and a so-called color coupler which forms a dye complementary to the light to which it is sensitive (i.e., yellow for blue, magenta for green, cyan for red) to provide color reproduction in a substractive color process. The light-sensitive layer and the color hue of the coupler may not have the aforementioned correspondence.

As the silver halide emulsion to be used in the present invention there may be preferably used an emulsion comprising silver chloride, silver bromochloride or silver bromochloroiodide having a silver chloride content of 95 mol % or more, preferably having a silver iodide content of 1 mol % or less, more preferably 0.2 mol % or less.

The halogen composition of emulsion may be the same or different from grain to grain. The use of an emulsion having the same halogen composition among grains advantageously provides easy uniformalization of the properties of grains. The halogen composition distribution in the silver halide emulsion grain can be properly selected from the group consisting of so-called uniform-type structures in which the halogen composition is the same anywhere, so-called laminated structures in which the halogen composition differs from the core to the shell [single or plural], and structures in which nonlayer portions having different halogen compositions are localized inside or on the grains (portions having different halogen compositions are fused to the edge, corner or surface of the grains). In order to obtain a high sensitivity, the latter two structures are preferred to the uniform structures from the standpoint of pressure resistance. If the silver halide grains have such a structure, the border of the portions having different compositions may be a definite one or an indefinite one where a mixed crystal is formed by the difference in the halogen composition or a positively continuous structural change.

The photographic light-sensitive material suitable for rapid processing preferably comprises a so-called silver halide emulsion having a high silver chloride content, particularly 98 mol % or more.

Such a high silver chloride emulsion may preferably have a silver bromide-rich phase localized inside and/or on silver halide grains in a layer or non-layer form as mentioned above. The halogen composition of the aforementioned localized phase preferably has a silver bromide content of at least 10 mol %, more preferably 20 mol % or more. These localized phases may be preferably present inside the grains, on the edge or corner of the surface of the grains, or on the surface of the grains, particularly on the corner of the grains.

On the other hand, for the purpose of minimizing the sensitivity drop when the light-sensitive material is under pressure, uniform structure grains having a small inner halogen composition distribution may be preferably used.

The average grain size (number-average value of grain sizes as calculated in terms of diameter of circle having the same area as that of projected area of grains) of silver halide grains contained in the silver halide emulsion to be used in the present invention is preferably in the range of 0.1 μm to 2 μm.

The grain size distribution is preferably so-called monodisperse, as represented by a fluctuation coefficient (obtained by dividing the standard deviation of grain size distribution by the average grain size) as small as 20% or less, preferably 15% or less. For the purpose of obtaining a great latitude, several kinds of the aforementioned monodisperse emulsions may be preferably blended for one layer or may be preferably coated in multiple layers.

The silver halide grains to be contained in the photographic emulsion may have a regular crystal form such as cube, octahedron and tetradecahedron, an irregular crystal form such as sphere and tablet or composite thereof. The silver halide grains also may comprise a mixture of grains having various crystal forms. In the present invention, grains having the aforementioned regular crystal forms are contained in a weight proportion of 50% or more, preferably 70% or more, more preferably 90% or more.

Besides these emulsions, an emulsion comprising tabular grains having an average aspect ratio (diameter in terms of circle/thickness) of 5 or more, preferably 8 or more, in a weight proportion of 50% or more of the total grains as calculated in terms of projected area may be preferably used.

The preparation of emulsion to be used in the present invention can be accomplished by any suitable method as disclosed in P. Glafkides, "Chimie et Physique Photographique", Paul Montel, 1967, G. F. Duffin, "Photographic Emulsion Chemistry", The Focal Press, 1966, and V. L. Zelikman et al., "Making and Coating Photographic Emulsion", The Focal Press, 1964. In some detail, the emulsion can be prepared by any of the acid process, the neutral process, the ammonia process, etc. The reaction between a soluble silver salt and a soluble halogen salt can be carried out by any of a single jet process, a double jet process, a combination thereof, and the like. A method in which grains are formed in the presence of excess silver ions (so-called reverse mixing method) may be used. Further, a so-called controlled double jet process, in which a pAg value of a liquid phase in which silver halide grains are formed is maintained constant, may also be used. According to the controlled double jet process, a silver halide emulsion having a regular crystal form and an almost uniform grain size can be obtained.

The silver halide emulsion to be used in the present invention may comprise various polyvalent metallic ion impurities for the purpose of enhancing the sensitivity during the formation or physical ripening of emulsion grains or improving the reciprocity law properties, the humidity and toner element depedence upon exposure or the latent image preservability. Examples of such a compound include salts of cadmium, zinc, lead, copper and thallium, and salts or complex salts of the group VIII elements such as iron, ruthenium, rhodium, palladium, osmium, iridium and platinum. In particular, complex salts of the group VIII elements can be preferably used. The added amount of such a compound can widely vary depending on the purpose but is preferably in the range of $10^{-9}$ to $10^{-2}$ mol per mol of silver halide.

The silver halide emulsion to be used in the present invention may be subjected to chemical sensitization and spectral sensitization.

The chemical sensitization can be accomplished by sulfur sensitization exemplified by the addition of an unstable sulfur compound, selenium sensitization, noble metal sensitization exemplified by gold sensitization, or reduction sensitization, singly or in combination.

The spectral sensitization is conducted for the purpose of making the emulsion contained in the various layers in the photographic light-sensitive material of the present invention spectrally sensitive to the desired light wavelength range. In the present invention, the spectral sensitization may be preferably effected by adding a dye which absorbs light in the wavelength range corresponding to the desired spectral sensitivity (spectral sensitizing dye). As such a spectral sensitizing dye there may be used those described in F. M. Harmer, "Heterocyclic compounds-Cyanine dyes and related compounds", John Wiley & Sons, New York, London, 1964. Specific preferred examples of such a compound and spectral snesitization process are described in JP-A-62-215272, upper right column, page 22, to page 38.

The silver halide emulsion to be used in the present invention may comprise various compounds and precursors thereof for the purpose of inhibiting fogging during the preparation, storage or photographic processing of the photographic light-sensitive material or stabilizing the photographic properties of the photographic light-sensitive material. Specific preferred examples of such compounds include those described in JP-A-62-215272, pp. 39-72.

The emulsion to be used in the present invention may be either of the so-called surface latent image type in which a latent image is formed mainly on the surface of the emulsion grains or the so-called internal latent image type in which a latent image is formed mainly inside the emulsion grains.

As the gelatin to be used in the present invention there may be preferably used deionized gelatin. In general, most gelatins contain calcium ions as much as 5,000 ppm or more. As the deionized gelatin to be used in the present invention there may be preferably used those containing calcium ions in an amount of 500 ppm or less. The deionized gelatin may be preferably used in an amount of 10% by weight or more, more preferably 20% by weight or more, particularly 50% by weight or more based on the total weight of gelatins. Such a gelatin may be incorporated in any layers.

The cyan coupler-containing layer and magenta coupler-containing layer, or yellow coupler-containing layer and interlayer of the present invention may comprise an inhibitor for color mixing incorporated therein.

As such an inhibitor for color mixing there may be preferably used a hydroquinone compound represented by the general formula (I) disclosed in Japanese Patent Application No. 3-302666.

As the ultraviolet absorbent to be incorporated in the upper portion of the cyan coupler-containing layer of the present invention there may be used any proper compound. Preferred examples of such an ultraviolet absorbent include thiazolidone, benzotriazole, acrylonitrile, benzophenone and aminobutadiene ultraviolet absorbents. Examples of these ultraviolet absorbents are disclosed in U.S. Pat. Nos. 1,023,859, 2,685,512, 2,739,888, 2,784,087, 2,748,021, 3,004,896, 3,052,636, 3,215,530, 3,253,921, 3,533,794, 3,692,525, 3,705,805, 3,707,375, 3,738,837, and 3,754,919, and British Patent 1,321,355.

In the present invention, as the magenta coupler there may be preferably used 5-pyrazolone magenta coupler or pyrazoloazole magenta coupler. In particular, imidazol[1,2-b] pyrazoles as disclosed in U.S. Pat. No. 4,500,630 are preferred in the light of the reduction of yellow secondary absorption and the light fastness of imaging dye. In particular, pyrazol[1,5-b]-[1,2,4]triazole disclosed in U.S. Pat. No. 4,540,654 is preferred.

Besides these magenta couplers, pyrazolotriazole couplers having branched alkyl group directly connected to the 2, 3 or 6-position of pyrazoloazole ring as described in JP-A-61-65245, pyrazoloazole couplers containing sulfonamide group in molecule as described in JP-A-61-65246, pyrazoloazole couplers having alkoxyphenylsulfonamide ballast group as described in JP-A-61-147254, and pyrazoloazole couplers having alkoxy group or aryloxy group in the 6-position as described in European Patent Disclosure No. 226,849 and 294,785 may be preferably used.

For the purpose of improving image sharpness or the like, the photographic light-sensitive material of the present invention may preferably comprise a dye capable of being decolored upon processing (particularly oxonol dye) as described in European Patent 0,337,490A, pp. 27–76 in the hydrophilic colloidal layer in such an amount that the optical reflection density of the photographic light-sensitive material at 680 nm reaches 0.70 or more or titanium oxide surface-treated with a divalent, trivalent or tetravalent alcohol (e.g., trimethylolethane) or the like in a water-resistant resin layer in the support in an amount of 12% by weight or more (more preferably 14% by weight or more).

The photographic additives such as cyan, magenta and yellow couplers to be used in the present invention may be preferably used in solution in a high boiling organic solvent. As such a high boiling organic solvent there may be used any good solvent for coupler nonmiscible with water having a melting point of 100° C. or lower and a boiling point of 140° C. or higher. The melting point of such a high boiling organic solvent is preferably 80° C. or lower. The boiling point of such a high boiling organic solvent is preferably 160° C. or higher, more preferably 170° C. or higher.

For the details of these high boiling organic solvents, reference can be made to JP-A-62-215272, lower right column, page 137 to upper right column, page 144.

The cyan, magenta or yellow coupler may be infiltrated through a loadable latex polymer (as disclosed in U.S. Pat. No. 4,203,716) in the presence or absence of the aforementioned high boiling organic solvent or dissolved with a water-insoluble and organic solvent-soluble polymer, and then emulsion-dispersed in an aqueous solution of a hydrophilic colloid.

Homopolymers or copolymers as described in U.S. Pat. No. 4,857,449, 7th column to 15th column, and WO88/00723, pp. 12–30, may be preferably used. More preferably, methacrylate or acrylamide polymers, particularly acrylamide polymers may be used.

The light-sensitive material of the present invention may preferably comprise a dye image preservability improving compound as disclosed in European Patent 0,277,589A2 in combination with couplers, particularly pyrazoloazole couplers or pyrroloazole cyan couplers of the present invention.

In particular, a compound (F) which undergoes chemical bonding to an aromatic amine developing agent remaining after color development to produce a chemically inert and substantially colorless compound and/or a compound (G) which undergoes chemical bonding to an oxidation product of an aromatic amine color developing agent remaining after color development to produce a chemically inert and substantially colorless compound may be preferably used singly or in combination to inhibit the occurrence of stain or other side effects caused by the formation of developed dyes by the reaction of a color developing agent or its oxidation product remaining in the film with a coupler in the storage after processing.

The light-sensitive material of the present invention may preferably comprise an antifungal substance as disclosed in JP-A-63-271247 to prevent from various mold and bacteria which can be propagated in the hydrophilic colloidal layer to deteriorate the image.

As the support to be used in the light-sensitive material of the present invention there can be used a white polyester support for display or a support having a white pigment-containing layer on a basic support of the silver halide emulsion layer side. In order to further improve the image sharpness, an antihalation layer may be preferably coated on the silver halide emulsion side or opposite side of the support. In order to enable display through reflected light or transmitted light, the transmission density of the support is preferably adjusted to a range of 0.35 to 0.8.

As such a support there may be used a reflective support or transmission support. More preferably, a reflective support may be used for the objects of the present invention.

The light-sensitive material of the present invention may be exposed to visible light or infrared light. Exposure may be carried out by a low intensity exposure process or a high intensity short time exposure process. In the latter case, laser scanning exposure process with an exposure time of less than $10^{-4}$ seconds per pixel may be preferably used.

A band stop filter as disclosed in U.S. Pat. No. 4,880,726 may be preferably used for exposure. This removes light stain, providing a remarkable enhancement of color reproducibility.

As silver halide emulsions and other materials (additives) to be incorporated in the light-sensitive material of the present invention, photographic constituent layers of the light-sensitive material of the present invention, and processing methods and processing additives to be used in the processing of the light-sensitive material of the present invention there can be preferably used those described in the following patents, particularly European Patent 0,355,660A2 (corresponding to JP-A-2-139544):

| Photographic constituent | JP-A-62-215272 | JP-A-2-33144 | EP0,355,660A2 |
|---|---|---|---|
| Silver halide emulsion | Line 6, upper right column, p. 10–line 5, lower left column, p. 12 & last line 4, lower right column, p. 12–line 17, upper left column, p. 13 | Line 16, upper right column, p. 28–line 11, lower right column, p. 29 & line 2–line 5, p. 30 | Line 53, p. 45–line 3, p 47 & line 20–line 22, p. 47 |
| Silver halide solvent | Line 6–line 14, lower left column, p. 12 & last line 3, upper left column, p. 13–last line, lower left column, p. 18 | — | — |
| Chemical sensitizer | Last line 3, lower left column–last line 5, lower right column, p. 12 & line 1, lower right column, p. 18–last line 9, upper right column, p. 22 | Line 12–last line, lower right column, p. 29 | Line 4–line 9, p. 47 |
| Spectral sensitizer (spectral sensitizing process) | Last line 8, upper right column, p. 22–last line on p. 38 | Line 1–line 13, upper left column, p. 30 | Line 10–line 15, p. 47 |
| Emulsion stabilizer | Line 1, upper left column, p. 39–last line, upper right column, p. 72 | Line 14, upper left column–line 1, upper right, p. 30 | Line 16–line 19, p. 47 |
| Development accelerator | Line 1, lower left column, p. 72–line 3, upper right column, p. 91 | — | — |
| Color coupler (cyan, magenta, yellow couplers) | Line 4, upper right column, p. 91–line 6, upper left column, p. 121 | Line 14, upper right column, p. 3–last line, upper left column, p. 35 | Line 15–line 27, p. 4, & line 30, p. 5–last line on p. 28, & line 29–line 31, p. 45 & line 23, p. 47–line 50, p. 63 |
| Color intensifier | Line 7, upper left column, p. 121–line 1, upper right column, p. 125 | — | — |
| Ultraviolet absorbent | Line 2, upper right column, p. 125–last line, lower left column, p. 127 | Line 14, lower right column, p. 37–line 11, upper left column, p. 38 | Line 22–line 31, p. 65 |
| Discoloration inhibitor (image stabilizer) | Line 1, lower right column, p. 127–line 8, lower left column, p. 137 | Line 12, upper right column, p. 36–line 19, upper left column, p. 37 | Line 30, p. 4–line 23, p. 5, & line 1, p. 29–line 25, p. 45, & line 33–40, p. 45 & line 2–21, p. 65 |
| High boiling and/or low boiling organic solvent | Line 9, lower left column, p. 137–last line, upper right column, p. 144 | Line 14, lower right column, p. 35–last line 4, upper left column, p. 36 | Line 1–51, p. 64 |
| Process for dispersion of photographic additives | Line 1, lower left column, p. 144–line 7, upper right column, p. 146 | Line 10, lower right column, p. 27–last line, upper left column, p. 28 & line 12, lower right column–line 7, upper right column, p. 36 | Line 51, p. 63–line 56, p. 64 |
| Film hardener | Line 8, upper right column, p. 146–line 4, lower left column, p. 155 | — | — |
| Developing | Line 5, lower left column, | | |

-continued

| Photographic constituent | JP-A-62-215272 | JP-A-2-33144 | EP0,355,660A2 |
|---|---|---|---|
| agent precursor | p. 155–line 2, lower right column, p. 155 | | |
| Development inhibitor-releasing compound | Line 3–9, lower right column, p. 155 | — | — |
| Support | Line 19, lower right column, p. 155–line 14, upper left column, p. 156 | Line 18, upper right column, p. 38–line 3, upper left column, p. 39 | Line 29 on p. 66–line 13 on p. 67 |
| Constitution of light-sensitive layers | Line 15, upper left column, p. 156–line 14, lower right column, p. 156 | Line 1–15, upper right column, p. 28 | Line 41–52, p. 45 |
| Dye | Line 15, lower right column, p. 156–last line, lower right column, p. 184 | Line 12, upper left column,–line 7, upper right column, p. 38 | Line 18–line 22, p. 66 |
| Diacoloration inhibitor | Line 1, upper left column, p. 185–line 3, lower right column, p. 188 | Line 8–11, upper right column, p. 36 | Line 57 on p. 64–line 1 on p. 65 |
| Gradation adjustor | Line 4–8, lower right column, p. 188 | — | — |
| Stain inhibitor | Line 9, lower right column, p. 188–line 10, lower right column, p. 193 | Last line, upper left column–line 13, lower right column, p. 37 | Line 32, p. 65–line 17, p. 66 |
| Surface active agent | Line 1, lower left column, p. 201–last line, upper right column, p. 210 | Line 1, upper right column, p. 18–last line, lower right column, p. 24 & last line 10, lower left column–line 9, lower right column, p. 27 | — |
| Fluorine-containing compound (antistatic agent, coating aid, lubricant, adhesion inhibitor) | Line 1, lower left column, p. 210–line 5, lower left column, p. 222 | Line 1, upper left column, p. 25–line 9, lower right column, p. 27 | — |
| Binder (hydrophilic colloid) | Line 6, lower left column, p. 222–last line, upper left column, p. 225 | Line 8–18, upper left column, p. 38 | Line 23–28 on p. 66 |
| Thickening agent | Line 1, upper right column, p. 225–line 2, upper right column, p. 227 | — | — |
| Antistatic agent | Line 3, upper right column, p. 227–line 1, upper left column, p. 230 | — | — |
| Polymer latex | Line 2, upper left column, p. 230–last line, p. 239 | — | — |
| Matting agent | Line 1, upper left column, p. 240–last line, upper right column, p. 240 | — | — |
| Photographic processing method (processing step, additives, etc.) | Line 7, upper right column, p. 3–line 5, upper right column, p. 10 | Line 4, upper left column, p. 39–last line, upper left column, p. 42 | Line 14, p. 67–line 28, p. 69 |

Note)
The contents cited in JP-A-62-215272 include the contents described in the written amendment of procedure dated March 16, 1987 attached thereto.
Among the above mentioned color couplers, as yellow couplers there may also be preferably used short wave type yellow couplers as disclosed in JP-A-63-231451, JP-A-63-123047, JP-A-63-241547, JP-A-1-173499, JP-A-1-213648, and JP-A-1-250944. Further, cycloalkane acetonitride yellow couplers as described in JP-A-4-116643 and indolinocarbonylanilide yellow couplers as described in EP0,482,552 may be preferably used.

As the method for the processing of a silver halide color photographic material comprising a high silver chloride emulsion having a silver chloride content of 90 mol % or more there may be preferably used a method described in JP-A-2-207250, upper left column, page 27 to upper right column, page 34.

The present invention will be further described in the following examples, but the present invention should not be construed as being limited thereto.

EXAMPLE 1

Preparation of Emulsion $R_1$

To an aqueous solution obtained by adding 3.3 g of sodium chloride to an aqueous solution of lime-treated gelatin were added an aqueous solution containing 0.5 mol of silver nitrate and an aqueous solution containing 0.5 mol of sodium chloride at a temperature of 60° C. with vigorous stirring. To the material were then added an aqueous solution containing 0.45 mol of silver nitrate and an aqueous solution containing 0.45 mol of sodium chloride and an aqueous solution containing 0.45 mol of sodium chloride at a temperature of 60° C. with vigorous stirring. To the material was then added a copolymer of isobutene and maleic acid-1-sodium salt at a temperature of 40° C. to make sedimentation. The material was then washed with water and desalted. 90.0 g of lime-treated gelatin was then added to the material so that the pH and pAg values thereof were adjusted to 6.2 and 6.5, respectively. To the emulsion was then added a fine emulsion of silver bromide grains having a size of 0.05 μm in an amount of 0.005 mol as calculated in terms of silver at a temperature of 50° C. to form a silver bromide-rich phase on the surface of grains. The emulsion was then subjected to optimum chemical sensitization with a sulfur sensitizer (triethylthiourea). The finely divided silver bromide grains had previously contained potassium hexachloroiridiumate (IV).

Emulsion $R_1$ thus obtained was then evaluated for the grain shape, grain size and grain size distribution from its electron microphotograph. The emulsion grains were cubic. The grain size was 0.58 μm. The grain size fluctuation coefficient was 0.09. The grain size is represented by the average of diamter of circles having the same area as the projected area of grains. The grain size fluctuation coefficient is obtained by dividing the standard deviation of grain sizes by the average grain size.

Preparation of Emulsion $R_2$

Emulsion $R_2$ was prepared in the same manner as Emulsion $R_1$ except that the temperatue at which the aqueous solution of silver nitrate and the aqueous solution of sodium chloride were mixed was altered. The grain size and fluctuation coefficient of Emulsion $R_2$ thus obtained were 0.45 μm and 0.11, respectively.

Preparation of Photographic Light-sensitive Material

A polyethylene double-laminated paper support was subjected to corona discharge on its surface. A gelatin undercoating layer containing sodium dodecylbenzenesulfonate was coated on the surface of the support. Various photographic constituent layers were further coated on the undercoating layer to prepare a multi-layer color photographic paper having the following layer configuration (Specimen 101). The coating solution used had been prepared as follows:

Preparation of 5th Layer Coating Solution

To 19.1 g of a cyan coupler (Exemplary Compound 11), 10.4 g of an ultraviolet absorbent (UV-2), 19.1 g of a dye image stabilizer (Cpd-1), 0.58 g of a dye image stabilizer (Cpd-9), 8.7 g of a dye image stabilizer (Cpd-10), 8.7 g of a dye image stabilizer (Cpd-11), 0.58 g of a dye image stabilizer (Cpd-8), and 0.58 g of a dye image stabilizer (Cpd-12) were added 30.8 cc of ethyl acetate, 12.7 g of a solvent (Solv-6) and 0.58 g of a solvent (Solv-1) to make a solution. The solution was then added to 265 cc of a 20% aqueous solution of gelatin containing 37 cc of 10% sodium dodecylbenzenesulfonate. The material was then subjected to emulsion dispersion by an ultrasonic homogenizer to prepare an emulsion dispersion C. On the other hand, a silver bromochloride emulsion R (7:3 (silver molar ratio) of a large size emulsion $R_1$ comprising cubic grains having an average grain size of 0.58 μm and a grain size distribution fluctuation coefficient of 0.09 and a small size emulsion $R_2$ comprising cubic grains having an average grain size of 0.45 μm and a grain size distribution fluctuation coefficient of 0.11, both comprising silver halide grains 0.5 mol % silver bromide localized on the grain surface, the rest being silver chloride) was prepared in the previously mentioned manner. The emulsion dispersion C and the silver bromochloride emulsion R were mixed to prepare a 5th layer coating solution having the following composition. During the preparation of the coating solution, a red-sensitive sensitizing dye (Exemplary Compound 17) as shown in the table below and an aminostilbene compound were added to the material to effect spectral sensitization.

Silver halide emulsions and coating solutions for other layers were prepared in the same manner as the 5th layer. As a gelatin hardener for the various layers there was used 1-oxy-3,5-dichloro-s-triazine sodium salt.

To these layers were each added Cpd-15 and Cpd-16 in a total amount of 25.0 mg/m$^2$ and 50.0 mg/m$^2$, respectively.

The silver bromochloride emulsion in these light-sensitive emulsion layers comprised the following spectral sensitizing dyes:

Blue-sensitive Emulsion Layer

Sensitizing dye A

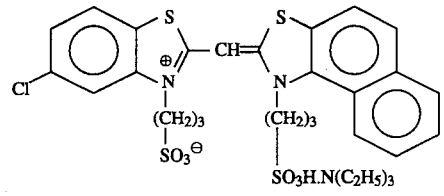

and

Sensitizing dye B

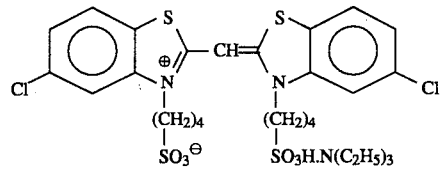

($2.0\times10^{-4}$ mol per mol of silver halide each for the large size emulsion and $2.5\times10^{-4}$ mol per mol of silver halide each for the small size emulsion)

Green-sensitive Emulsion Layer

Sensitizing dye C

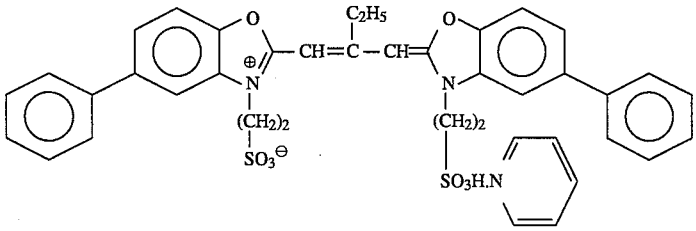

($4.0\times10^{-4}$ mol per mol of silver halide for the large size emulsion and $5.6\times10^{-4}$ mol per mol of silver halide for the small size emulsion)

Sensitizing dye D

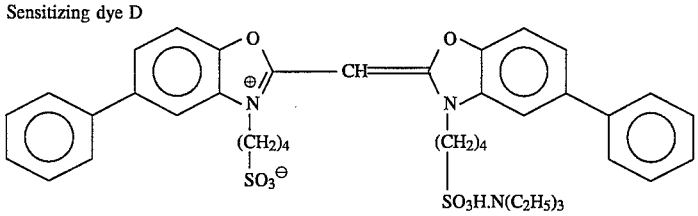

($7.0\times10^{-5}$ mol per mol of silver halide for the large size emulsion and $1.0\times10^{-4}$ mol per mol of silver halide for the small size emulsion)

Red-sensitive Emulsion Layer

Sensitizing dye E
(Exemplary Compound A-17)

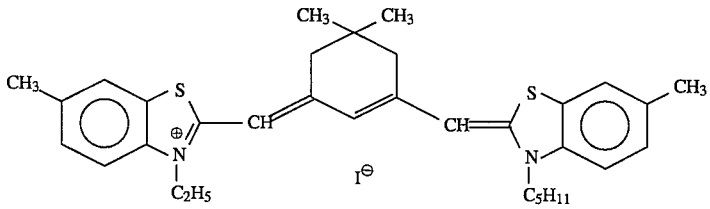

($0.9\times10^{-4}$ mol per mol of silver halide for the large size emulsion and $1.1\times10^{-4}$ mol per mol of silver halide for the small size emulsion)

Further, the following compound was incorporated in an amount of $2.6\times10^{-3}$ mol per mol of silver halide.

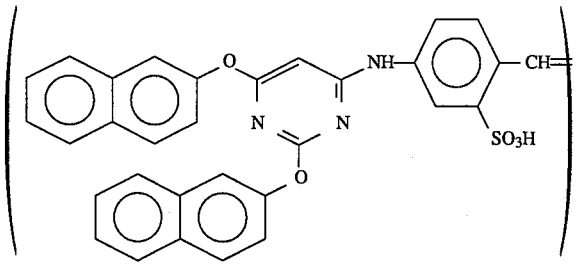

2

To the blue-sensitive emulsion layer, green-sensitive emulsion layer and red-sensitive emulsion layer was each added 1-(5-methylureidophenyl)-5-mercaptotetrazole in an amount of $3.4\times10^{-5}$ mol, $9.7\times10^{-4}$ mol and $5.5\times10^{-4}$ mol per mol of silver halide, respectively.

The silver halide emulsions used in the various silver halide emulsion layers were prepared in the same manner as Emulsion $R_1$.

To the blue-sensitive emulsion layer and green-sensitive emulsion layer was each added 4-hydroxy-6-methyl-1,3,3*a*,7-tetrazaindene in an amount of $1\times10^{-4}$ mol and $2\times10^{-4}$ mol per mol of silver halide, respectively. In order to inhibit irradiation, to these emulsion layers were each added the following dyes (figure in parenthesis indicates the coated amount):

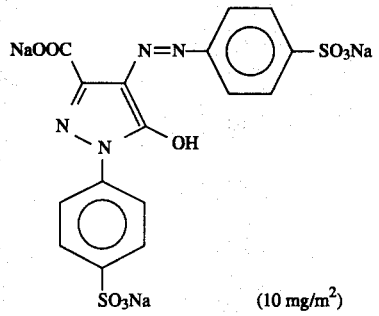

(10 mg/m$^2$)

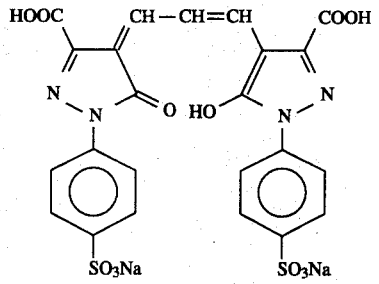

(10 mg/m$^2$)

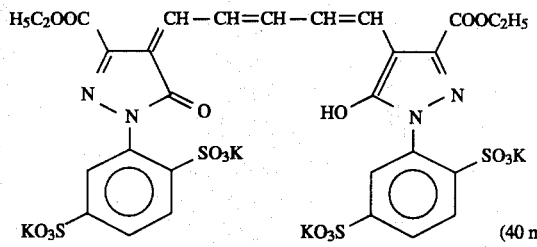

(40 mg/m$^2$)

and

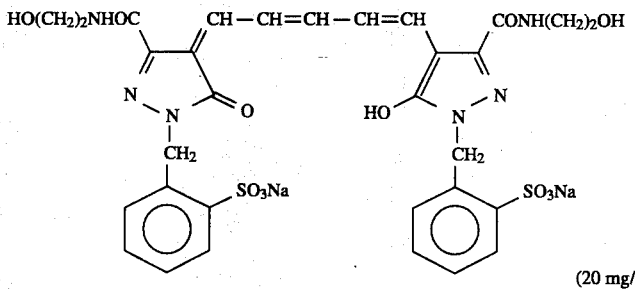

(20 mg/m$^2$)

Layer Constitution

The formulations of the various layers are set forth below. The figures indicate the coated amount (g/m$^2$). The coated amount of silver halide emulsion is represented as calculated in terms of silver.

Support

Polyethylene-laminated paper [containing a white pigment ($TiO_2$) and a bluish dye (ultramarine) in polyethylene on the 1st layer side]

| 1st layer (blue-sensitive emulsion layer) | |
|---|---|
| Above mentioned silver bromochloride emulsion B (6:4 (silver molar ratio) of a large size emulsion $B_1$ comprising cubic grains having an average grain size of 0.88 μm and a grain size distribution fluctuation coefficient of 0.10 and a small size emulsion $B_2$ comprising cubic grains having an average grain size of 0.70 μm and a grain size distribution fluctuation coefficient of 0.08, both comprising silver halide grains 0.3 mol % silver bromide localized partically on the grain surface, the rest being silver chloride | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |

-continued

| | |
|---|---|
| 2nd layer (color mixing inhibiting layer) | |
| Gelatin | 0.99 |
| Color mixing inhibitor (Cpd-4) | 0.08 |
| Solvent (Solv-2) | 0.25 |
| Solvent (Solv-3) | 0.25 |
| 3rd layer (green-sensitive emulsion layer) | |
| Silver bromochloride emulsion G (6:4 (Ag molar ratio) mixture of a large size emulsion $G_1$ of cubic grains having an average size of 0.55 μm with a grain size distribution fluctuation coefficient of 0.10 and a small size emulsion $G_2$ of cubic grains having an average size of 0.39 μm with a grain size distribution fluctuation coefficient of 0.08, 0.8 mol % of silver bromide being localized partially on the surface of each emulsion, the rest being silver halide grains) | 0.13 |
| Gelatin | 1.45 |
| Magenta coupler (ExM) | 0.16 |
| Dye image stabilizer (Cpd-6) | 0.15 |
| Dye image stabilizer (Cpd-2) | 0.03 |
| Dye image stabilizer (Cpd-7) | 0.01 |
| Dye image stabilizer (Cpd-8) | 0.01 |
| Dye image stabilizer (Cpd-9) | 0.08 |
| Solvent (Solv-3) | 0.50 |
| Solvent (Solv-4) | 0.15 |
| Solvent (Solv-5) | 0.15 |
| 4th layer (color mixing inhibiting layer) | |
| Gelatin | 0.70 |
| Color mixing inhibitor (Cpd-4) | 0.04 |
| Dye Image Stabilizer (Cpd-5) | 0.02 |
| Solvent (Solv-2) | 0.18 |
| Solvent (Solv-3) | 0.18 |
| 5th layer (red-sensitive emulsion layer) | |
| Above mentioned silver bromochloride emulsion R | 0.20 |
| Gelatin | 0.85 |
| Cyan coupler (Exemplary Compound 11) | 0.33 |
| Ultraviolet absorbent (UV-2) | 0.18 |
| Dye image stabilizer (Cpd-1) | 0.33 |
| Dye image stabilizer (Cpd-10) | 0.15 |
| Dye image stabilizer (Cpd-11) | 0.15 |
| Dye image stabilizer (Cpd-12) | 0.01 |
| Dye image stabilizer (Cpd-9) | 0.01 |
| Dye image stabilizer (Cpd-8) | 0.01 |
| Solvent (Solv-6) | 0.22 |
| Solvent (Solv-1) | 0.01 |
| 6th layer (ultraviolet abosrbing layer) | |
| Gelatin | 0.55 |
| Ultraviolet absorbent (UV-1) | 0.40 |

-continued

| | |
|---|---|
| Dye image stabilizer (Cpd-13) | 0.15 |
| Dye image stabilizer (Cpd-6) | 0.02 |
| 7th layer (protective layer) | |
| Gelatin | 1.13 |
| Acryl-modified copolymer of polyvinyl alcohol (modification degree: 17%) | 0.15 |
| Liquid paraffin | 0.03 |
| Dye image stabilizer (Cpd-14) | 0.01 |

The chemical structure of the compounds incorporated in these layers are set forth below.

Yellow Coupler (ExY)

1:1 (molar ratio) mixture of

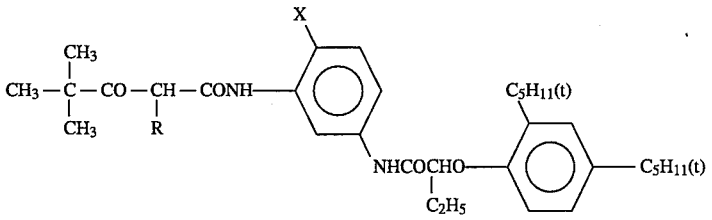

wherein R is

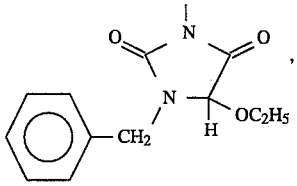

X=Cl and

R is

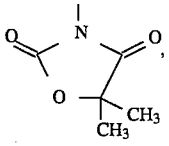

X=$OCH_3$

Magenta coupler (ExM)

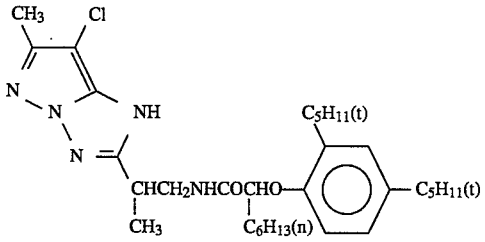

Dye stabilizer (Cpd-1)

-continued

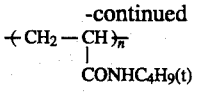

(Average molecular weight: 60,000)

Dye stabilizer (Cpd-2)

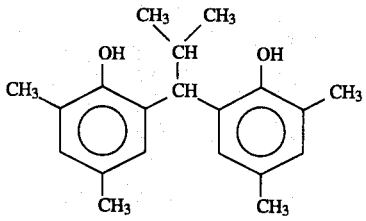

Dye stabilizer (Cpd-3)

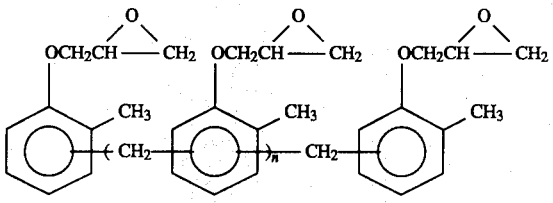

n = 7 to 8 (on average)

Color mixing inhibitor (Cpd-4)

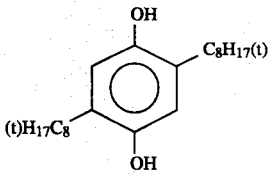

Dye image stabilizer (Cpd-5)

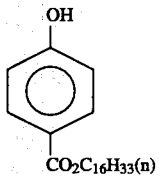

Dye image stabilizer (Cpd-6)

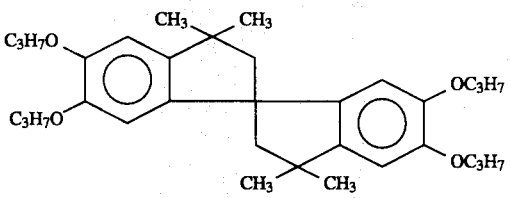

Dye image stabilizer (Cpd-7)

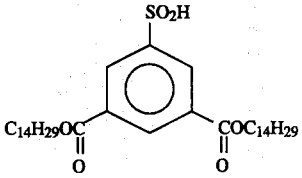

Dye image stabilizer (Cpd-8)

-continued

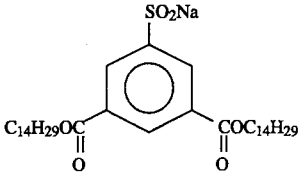

Dye image stabilizer (Cpd-9)

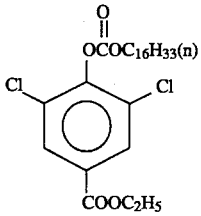

Dye image stabilizer (Cpd-10)

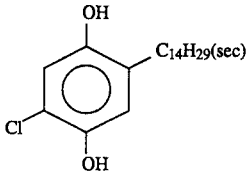

Dye image stabilizer (Cpd-11)

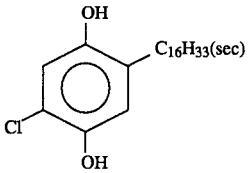

Dye image stabilizer (Cpd-12)

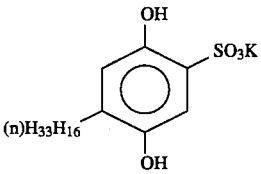

Dye image stabilizer (Cpd-13)

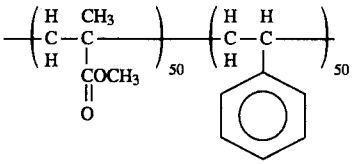

Average molecular weight: about $6.0 \times 10^4$

Dye image stabilizer (Cpd-14)

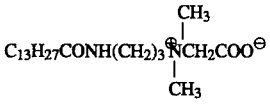

-continued
Preservative (Cpd-15)
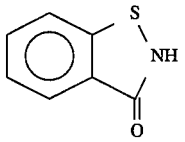
Preservative (Cpd-16)
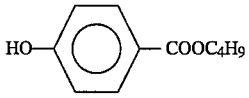
Ultraviolet Absorbent (UV-1)
1:5:10:5 (weight ratio) mixture of:
(i)
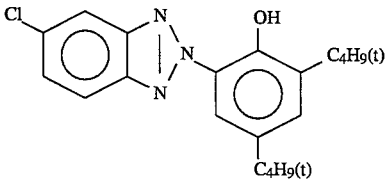
(ii)
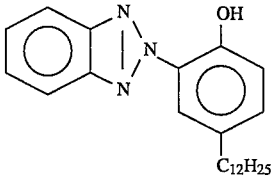
(iii)
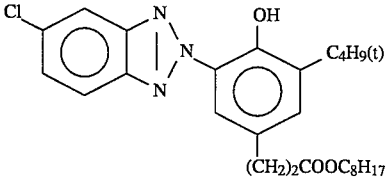
and
(iv)
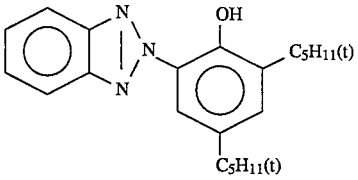
Ultraviolet Absorbent (UV-2)
1:2:2 mixture (weight ratio) of:
(v)
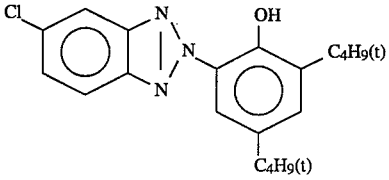
(vi)
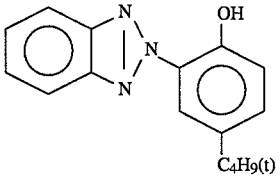
and
(vii)
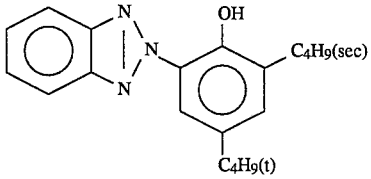
Solvent (Solv-1)
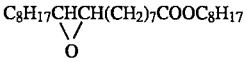
Solvent (Solv-2)
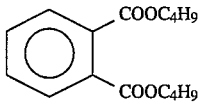
Solvent (Solv-3)
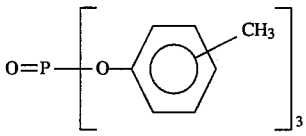
Solvent (Solv-4)
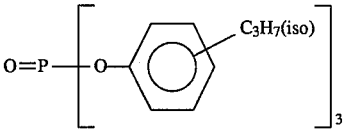
Solvent (Solv-5)
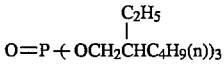
Solvent (Solv-6)

-continued

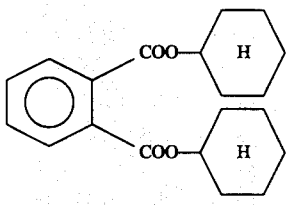

Specimens 102 to 121 were prepared in the same manner as Specimen 101 except that the cyan coupler and red-sensitive sensitizing dye to be incorporated in the 5th layer were replaced by cyan couplers and sensitizing dyes selected from exemplary compounds of the present invention or comparative couplers, etc. which are shown in Table B. In Specimens 101 to 121, coating was conducted 30 minutes after the preparation of the 5th layer coating solution. Specimens 401 to 421 were prepared in the same manner as Specimens 101 to 121 except that the time between the preparation of the 5th layer coating solution and the coating of the coating compositions was altered to 4 hours.

TABLE B

| Specimen No. | Cyan coupler used in 5th layer | Sensitizing dye used in 5th layer |
|---|---|---|
| 101 | Exemplary Compound (11) | A-17 |
| 102 | Comparative Coupler 1 | B-3 |
| 103 | " | Sens. 1 |
| 104 | " | Sens. 2 |
| 105 | " | Sens. 3 |
| 106 | " | A-17 |
| 107 | Comparative Coupler 2 | A-17 |
| 108 | Exemplary Compound (11) | B-3 |
| 109 | " | C-1 |
| 110 | " | D-1 |
| 111 | " | Sens. 1 |
| 112 | " | Sens. 2 |
| 113 | " | Sens. 3 |
| 114 | Exemplary Compound (10) | A-17 |
| 115 | Exemplary Compound (12) | A-17 |
| 116 | Exemplary Compound (14) | " |
| 117 | Exemplary Compound (16) | " |
| 118 | Exemplary Compound (18) | " |
| 119 | Exemplary Compound (20) | " |
| 120 | Exemplary Compound (21) | " |
| 121 | Exemplary Compound (34) | " |

(Sens-1)

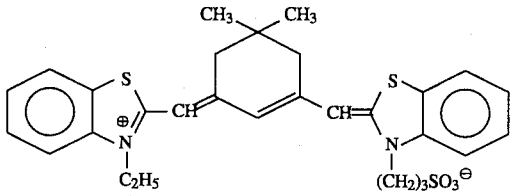

$E_R = -1.245$ (Sens-2)

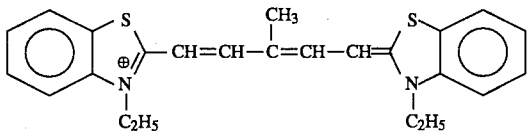

$I^{\ominus}$ $E_R = -1.16$ (Sens-3)

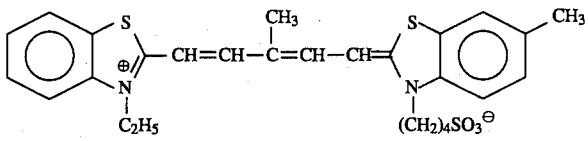

$E_R = -1.18$

Comparative Coupler 1

TABLE B-continued

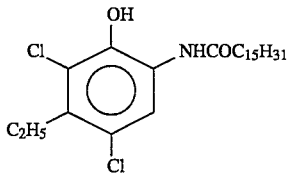

Comparative Coupler 2

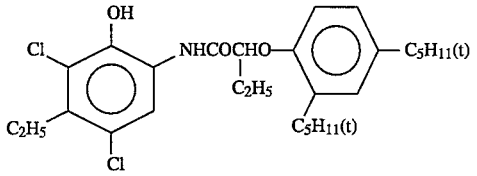

For the evaluation of dependence on exposure temperature, these specimens were stored at temperatures of 15° C. and 35° C. (55% RH) for 30 minutes, and then subjected to gradationwise exposure for sensitometry through blue, green and red filters by means of a sensitometer (FWH, avaialbe from Fuji Photo Film Co., Ltd.; color temperature of light source: 3,200° K) at the respective temperatures. The exposure was conducted in such a manner that an exposure of 250 CMS was reached in 0.1 second.

Specimen 101 which had been exposed to light was continuously processed with the following processing solutions in the following processing procedures by means of a paper processing machine in such a manner that a running balance state was obtained. The other specimens were then processed.

| Processing step | Temperature | Time | Replenisher* | Tank capacity |
|---|---|---|---|---|
| Color development | 35° C. | 45 sec. | 161 ml | 17 l |
| Blix | 30–35° C. | 45 sec. | 215 ml | 17 l |
| Rinse | 30° C. | 90 sec. | 350 ml | 10 l |
| Drying | 70–80° C. | 60 sec. | | |

*The replenishment rate is represented per $m^2$ of light-sensitive material.

The various processing solutions had the following compositions:

| Color developer | Running Solution | Replenisher |
|---|---|---|
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoanilinesulfate | 5.0 g | 7.0 g |
| N,N-bis(carboxymethyl)hydrazine | 4.0 g | 5.0 g |
| N,N-di(sulfoethyl)hydroxylamine.1Na | 4.0 g | 5.0 g |
| Fluorescent brigthening agent (WHITEX 4B, available from Sumitomo Chemical Co., Ltd.) | 1.0 g | 2.0 g |
| Water to make | 1,000 ml | 1,000 ml |
| pH (25° C.) | 10.05 | 10.45 |

Blix solution (running solution was used also as replenisher)

| | |
|---|---|
| Water | 400 ml |
| Ammonium thiosulfate (700 g/l) | 100 ml |
| Sodium sulfite | 17 g |
| Ammonium ethylenediaminetetraacetate (III) | 55 g |
| Disodium ethylenediaminetetraacetate | 5 g |
| Ammonium bromide | 40 g |
| Water to make | 1,000 ml |
| pH (25° C.) | 6.0 |

Rinse Solution (running solution was used also as replenisher)

Ion-exchanged water (calcium and magnesium concentration: 3 ppm or less each)

For the evaluation of the dependence of Specimens 101 to 121 on exposure temperature, the difference in the logarithm of the exposure (sensitivity) required to obtain a density of 1.0 between 15° C. exposure and 35° C. exposure was determined. The nearer to zero this difference is, the more improved is the dependence on exposure temperature. For the evaluation of the sensitivity change with ageing time of the coating solution, the sensitivity of specimens which had been exposed at a temperature of 15° C. was compared between Specimens 101 to 121 and Specimens 401 to 421. The nearer to zero this difference is, the less is the sensitivity change with ageing time of the coating solution.

The results are set forth in Table C. In the table, "Sensitivity at coating after 30 min. ageing" indicates the sensitivity of Specimens 101 to 121 while "Sensitivity at coating after 4 hr. ageing" indicates the sensitivity of Specimens 401 to 421.

TABLE C

| Specimen No. | Dependence on exposure temperature (sensitivty at 35° C.–sensitivity at 15° C.) | Ageing of coating solution (sensitivity at coating 4 hr. ageing–sensitivity at coating 30 min. ageing) |
|---|---|---|
| 101 | ±0 | −0.01 |
| 102 | 0.03 | −0.06 |
| 103 | 0.06 | −0.03 |
| 104 | 0.06 | −0.04 |
| 105 | 0.07 | −0.03 |
| 106 | 0.03 | −0.07 |
| 107 | 0.03 | −0.07 |
| 108 | 0.02 | −0.01 |
| 109 | 0.02 | −0.02 |
| 110 | 0.02 | −0.01 |
| 111 | 0.06 | −0.03 |
| 112 | 0.06 | −0.02 |
| 113 | 0.05 | −0.03 |
| 114 | ±0 | ±0 |
| 115 | ±0 | −0.01 |
| 116 | " | ±0 |
| 117 | " | −0.01 |
| 118 | " | −0.01 |

Yellow coupler (Ex3Y)

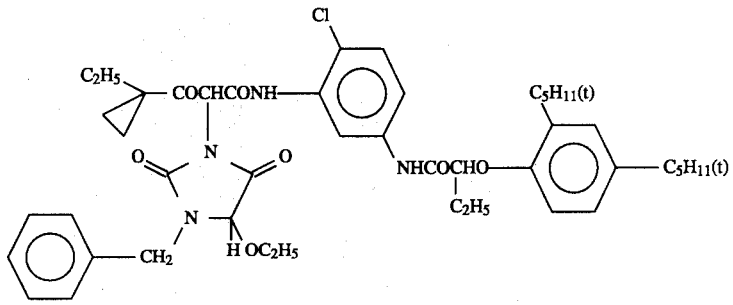

TABLE C-continued

| Specimen No. | Dependence on exposure temperature (sensitivty at 35° C.–sensitivity at 15° C.) | Ageing of coating solution (sensitivity at coating 4 hr. ageing–sensitivity at coating 30 min. ageing) |
|---|---|---|
| 119 | " | −0.01 |
| 120 | " | −0.01 |
| 121 | " | −0.01 |

(Note: Specimens 101, 108 to 110, and 114 to 121 are according to the present invention)

Specimens 102 to 107, which comprise cyan couplers not according to the present invention, showed an appreciable difference in the dependence on exposure temperature and the sensitivity change with ageing time of the coating solution from one sensitizing dye to another. In particular, Specimens 102 and 107 comprise sensitizing dyes of the present invention to improve the dependence on exposure temperature but exhibit an increased desensitization with ageing time of the coating solution. On the contrary, Specimen 101, Specimens 108 to 110, and Specimens 114 to 121, which comprise sensitizing dyes and cyan couplers of the present invention, exhibit an improved dependence on exposure temperature and a reduced desensitization with ageing time of the coating solution.

EXAMPLE 2

Silver halide emulsions $R_3$ and $R_4$ were prepared in the same manner as the silver halide emulsions $R_1$ and $R_2$ to be used in the 5th layer coating solution of Example 1 except that chloroauric acid was used in addition to the sulfur sensitizer (triethylthiourea) for the optimum chemical sensitization.

Further, Emulsions $G_3$, $G_4$, $B_3$ and $B_4$ were prepared in the same manner as Emulsions $G_1$, $G_2$, $B_1$ and $B_2$ except that the chemical sensitization was similarly changed.

Specimens 201, 203, and 207 to 211, which comprise coating solution aged 30 minutes, and Specimens 501, 503, and 507 to 511, which comprise coating solution aged 4 hours, as set forth in Table D were prepared in the same manner as Specimens 101, 103, 107 to 111, 401, 403, and 407 to 411 except that the silver halide emulsions $R_1$, $R_2$, $B_1$, $B_2$, $G_1$ and $G_2$ were replaced by silver halide emulsions $R_3$, $R_4$, $B_3$, $B_4$, $G_3$ and $G_4$, respectively, and the yellow couplers to be incorporated in the 1st layer were replaced by E×3Y, respectively, in the equimolecular amount. These specimens were evaluated in the same manner as in Example 1.

TABLE D

| Specimen No. | Cyan coupler used in 5th layer | Sensitizing dye used in 5th layer | Emulsion used in 5th layer |
|---|---|---|---|
| 101 | Exemplary Compound (11) | A-17 | $R_1$, $R_2$ |
| 103 | Comparative Coupler 1 | Sens. 1 | " |
| 107 | Comparative Coupler 2 | A-17 | " |
| 108 | Exemplary Compound (11) | B-3 | " |
| 109 | " | C-1 | " |
| 110 | " | D-1 | " |
| 111 | " | Sens. 1 | " |
| 201 | Exemplary Compound (11) | A-17 | $R_3$, $R_4$ |
| 203 | Comparative Coupler 1 | Sens. 1 | " |
| 207 | Comparative Coupler 2 | A-17 | " |
| 208 | Exemplary Compound (11) | B-3 | " |
| 209 | " | C-1 | " |
| 210 | " | D-1 | " |
| 211 | " | Sens. 1 | " |

The results are set forth in Table E.

TABLE E

| Specimen No. | Dependence on exposure temperature (sensitivty at 35° C.–sensitivity at 15° C.) | Ageing of coating solution (sensitivity at coating 4 hr. ageing–sensitivity at coating 30 min. ageing) |
|---|---|---|
| 101 | ±0 | ±0 |
| 103 | 0.06 | −0.03 |
| 107 | 0.03 | −0.07 |
| 108 | 0.02 | −0.02 |
| 109 | 0.02 | −0.02 |
| 110 | 0.02 | −0.02 |
| 111 | 0.06 | −0.03 |
| 201 | ±0 | ±0 |
| 203 | 0.05 | −0.03 |
| 207 | 0.03 | −0.06 |
| 208 | 0.02 | −0.02 |
| 209 | 0.02 | −0.02 |
| 210 | 0.02 | −0.02 |
| 211 | 0.06 | −0.03 |

(Note: Specimens 101, 108 to 110, 201, and 208 to 210 are according to the present invention)

Table E shows that the effects of the present invention become more remarkable when a gold-sensitized emulsion is used.

EXAMPLE 3

Specimens were prepared in the same manner as Specimen 101 of Example 1 except that the layer constitution and yellow couplers used were altered as set forth below. Further specimens were prepared in the same manner as all the specimens used in Examples 1 and 2 except that the layer constitution and yellow couplers used were similarly altered. These specimens were examined in the same manner as in Example 1. Also in the present example, mercaptotetrazoles, tetrazaindenes, gelatin hardeners, irradiation-inhibiting dyes, and spectral sensitizing dyes as used in Example 1 were used.

Even in the case where the layer constitution was altered, similar effects of the present invention were recognized.

Layer Constitution

The formulations of the various layers are set forth below. The figures indicate the coated amount (g/m$^2$). The coated amount of silver halide emulsion is represented as calculated in terms of silver.

Support

Polyethylene-laminated paper [containing a white pigment ($TiO_2$) and a bluish dye (ultramarine) in polyethylene on the 1st layer side]

| | |
|---|---|
| 1st layer (blue-sensitive emulsion layer) | |
| Silver bromochloride emulsion B of Example 1 | 0.30 |
| Gelatin | 1.22 |
| Yellow coupler (Ex5Y) | 1.01 |
| Dye image stabilizer (Cpd-17) | 0.19 |
| Solvent (Solv-8) | 0.18 |
| Solvent (Solv-1) | 0.18 |
| Dye image stabilizer (Cpd-1) | 0.06 |
| 2nd layer (color mixing inhibiting layer) | |
| Gelatin | 0.64 |
| Color mixing inhibitor (Cpd-4) | 0.10 |
| Solvent (Solv-2) | 0.16 |
| Solvent (Solv-3) | 0.08 |
| 3rd layer (green-sensitive emulsion layer) | |
| Silver bromochloride emulsion G of Example 1 | 0.12 |
| Gelatin | 1.28 |
| Magenta coupler (ExM) | 0.23 |
| Dye image stabilizer (Cpd-9) | 0.03 |
| Dye image stabilizer (Cpd-6) | 0.16 |
| Dye image stabilizer (Cpd-18) | 0.02 |
| Dye image stabilizer (Cpd-2) | 0.02 |
| Solvent (Solv-7) | 0.40 |
| 4th layer (ultraviolet abosrbing layer) | |
| Gelatin | 1.41 |
| Ultraviolet absorbent (UV-3) | 0.47 |
| Color stain inhibitor (Cpd-4) | 0.05 |
| Solvent (Solv-8) | 0.24 |
| 5th layer (red-sensitive emulsion layer) | |
| Silver bromochloride emulsion R of Example 1 | 0.23 |
| Gelatin | 1.04 |
| Cyan coupler (Exemplary Compound 11) | 0.32 |
| Dye image stabilizer (Cpd-9) | 0.03 |
| Dye image stabilizer (Cpd-18) | 0.02 |
| Ultraviolet absorbent (UV-2) | 0.18 |
| Dye image stabilizer (Cpd-1) | 0.40 |
| Dye image stabilizer (Cpd-19) | 0.05 |
| Solvent (Solv-10) | 0.14 |
| 6th layer (ultraviolet absorbing layer) | |
| Gelatin | 0.48 |
| Ultraviolet absorbent (UV-3) | 0.16 |
| Color stain inhibitor (Cpd-4) | 0.02 |
| Solvent (Solv-9) | 0.08 |

-continued

| 7th layer (protective layer) | |
|---|---|
| Gelatin | 1.10 |
| Acryl-modified copolymer of polyvinyl alcohol (modification degree: 17%) | 0.17 |
| Liquid paraffin | 0.03 |

Dye image stabilizer (Cpd-17)

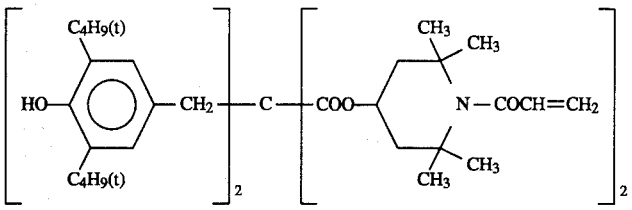

Dye image stabilizer (Cpd-18)

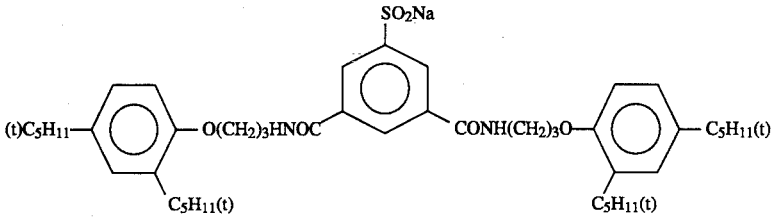

Dye image stabilizer (Cpd-19)

1:1 (weight ratio) mixture of:

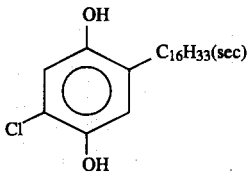

and

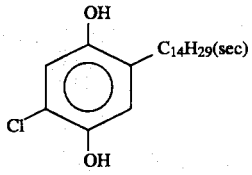

Ultraviolet absorbent (UV-3)

4:2:4 (weight ratio) mixture of:

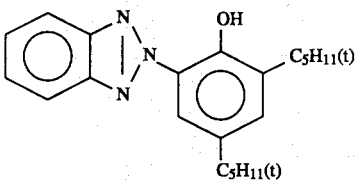

-continued

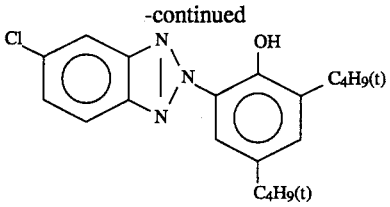

and

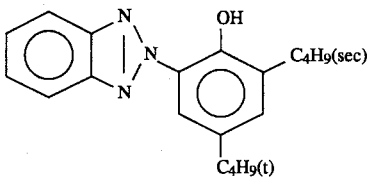

Solvent (Solv-7)

1:1 (weight ratio) mixture of:

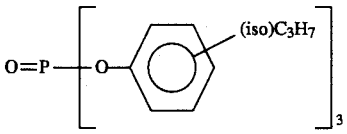

and

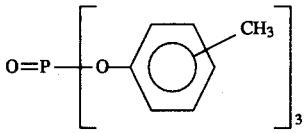

Solvent (Solv-8)

$O{=}P{-}[O{-}C_9H_{19}(iso)]_3$

-continued

Solvent (Solv-9)

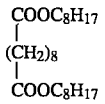

Solvent (Solv-10)

80:20 (weight ratio) mixture of:

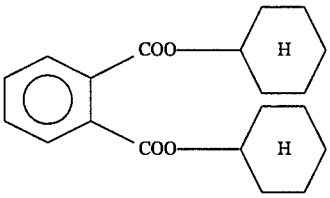

and

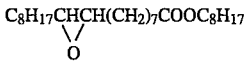

Yellow coupler (Ex5Y)

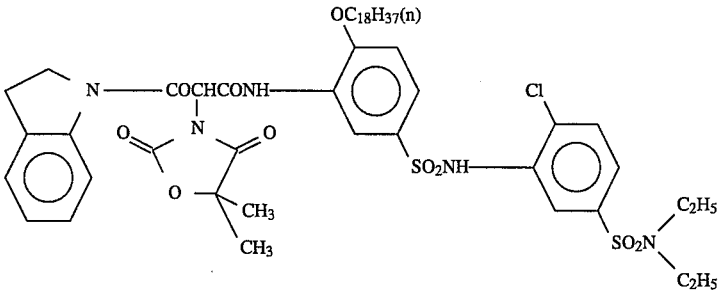

EXAMPLE 4

Specimens 501 to 540 were prepared in the same manner as in Example 1 except that the sensitizing dye and cyan coupler to be incorporated in the 5th layer were altered as set forth in Table F. These specimens were evaluated in the same manner as in Example 1. For the evaluation of the ageing stability of the coating solution, specimens were prepared in the same manner as Specimens 501 to 540 except that the coating solutions were aged for different times as in Example 1.

The results are shown in Table G.

TABLE F

| Specimen No. | Cyan coupler used in 5th layer | Sensitizing dye used in 5th layer |
|---|---|---|
| 101 | Exemplary Compound (11) | A-17 |
| 501 | Comparative Coupler 3 | " |
| 502 | Comparative Coupler 4 | " |
| 503 | Comparative Coupler 5 | " |
| 504 | Comparative Coupler 6 | " |
| 505 | Comparative Coupler 7 | " |
| 506 | Comparative Coupler 8 | " |
| 507 | Comparative Coupler 9 | " |
| 508 | Exemplary Compound (11) | A-2 |
| 509 | " | A-4 |
| 510 | " | A-6 |
| 511 | " | A-8 |
| 512 | " | A-10 |
| 513 | " | A-12 |
| 514 | " | A-14 |
| 515 | " | A-16 |
| 516 | " | A-18 |
| 517 | " | B-1 |
| 518 | " | B-2 |
| 519 | " | C-3 |
| 520 | " | C-4 |
| 521 | " | D-3 |
| 522 | " | D-4 |
| 523 | " | Sens. 4 |
| 524 | " | Sens. 5 |
| 525 | " | Sens. 6 |
| 526 | " | Sens. 7 |
| 527 | " | Sens. 8 |
| 528 | " | Sens. 9 |
| 529 | " | Sens. 10 |
| 530 | Exemplary Compound (2) | A-10 |
| 531 | Exemplary Compound (4) | " |
| 532 | " | " |
| 533 | Exemplary Compound (6) | " |
| 534 | Exemplary Compound (22) | " |
| 535 | Exemplary Compound (25) | " |
| 536 | Exemplary Compound (29) | " |
| 537 | Exemplary Compound (31) | " |
| 538 | Exemplary Compound (33) | " |
| 539 | Exemplary Compound (35) | " |
| 540 | Exemplary Compound (38) | " |

<Comparative spectral sensitizing dye>

Sens. 4

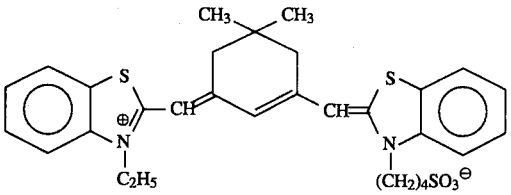

$E_R = -1.24$

Sens. 5

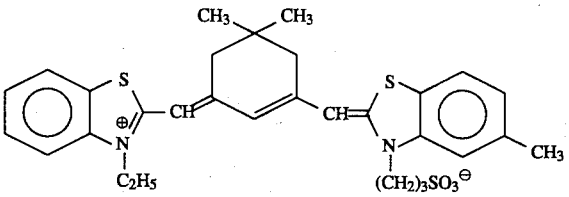

$E_R = -1.26$

Sens. 6

TABLE F-continued
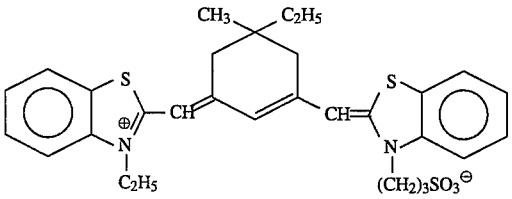
$E_R = -1.25$
Sens. 7
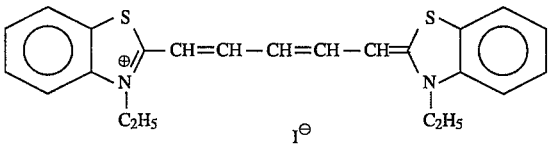
$E_R = -1.14$
Sens. 8
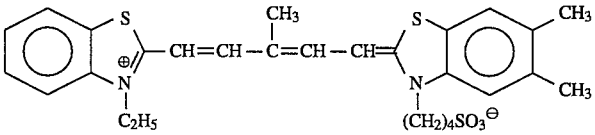
$E_R = -1.22$
Sens. 9
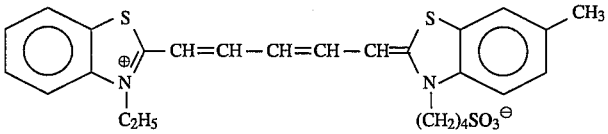
$E_R = -1.16$
Sens. 10
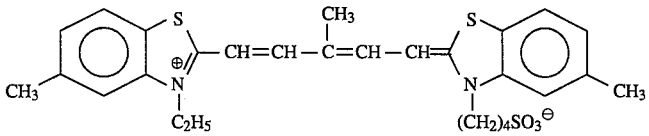
$E_R = -1.21$
Comparative coupler 3
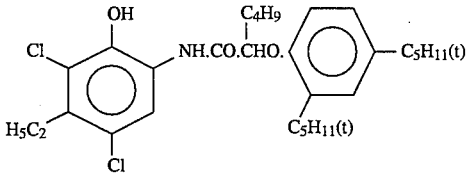
Comparative coupler 4
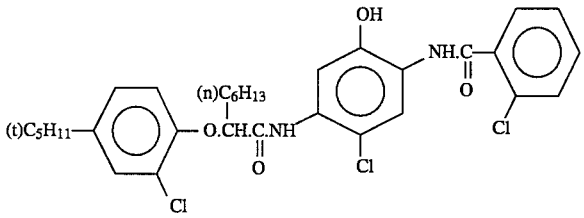

TABLE F-continued

Comparative coupler 5

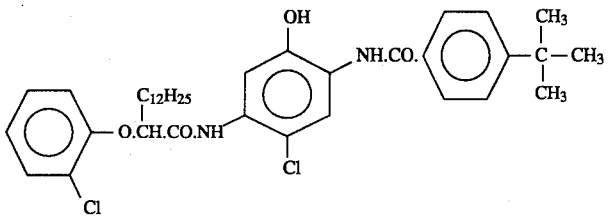

Comparative coupler 6

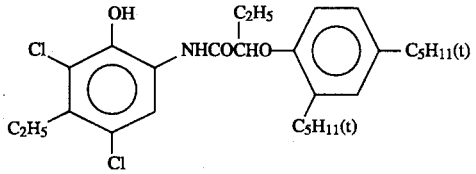

Comparative coupler 7

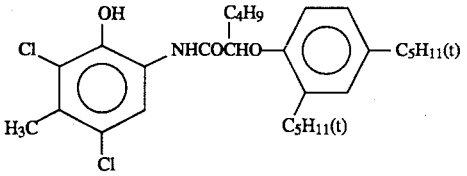

Comparative coupler 8

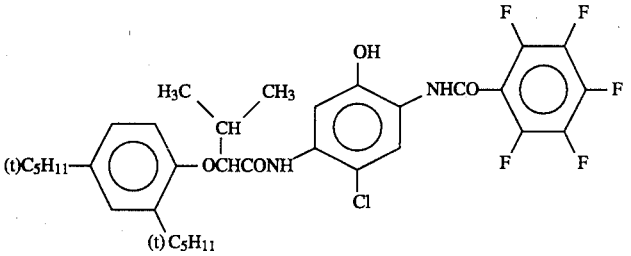

Comparative coupler 9

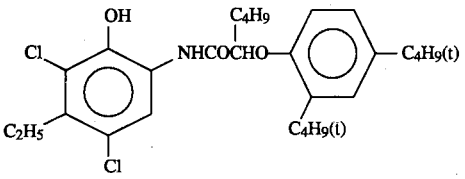

TABLE G

| Specimen No. | Dependence on exposure temperature (sensitivty at 35° C.–sensitivity at 15° C.) | Ageing of coating solution (sensitivity at coating 4 hr. ageing–sensitivity at coating 30 min. ageing) |
|---|---|---|
| 101 | ±0 | −0.02 |
| 501 | 0.02 | −0.06 |
| 502 | 0.02 | −0.06 |
| 503 | 0.02 | −0.07 |
| 504 | 0.03 | −0.05 |
| 505 | 0.02 | −0.06 |
| 506 | 0.02 | −0.06 |

TABLE G-continued

| Specimen No. | Dependence on exposure temperature (sensitivty at 35° C.–sensitivity at 15° C.) | Ageing of coating solution (sensitivity at coating 4 hr. ageing–sensitivity at coating 30 min. ageing) |
|---|---|---|
| 507 | 0.02 | −0.07 |
| 508 | ±0 | −0.01 |
| 509 | ±0 | −0.01 |
| 510 | ±0 | −0.01 |
| 511 | ±0 | −0.01 |
| 512 | ±0 | −0.01 |
| 513 | ±0 | −0.01 |

TABLE G-continued

| Specimen No. | Dependence on exposure temperature (sensitivty at 35° C.–sensitivity at 15° C.) | Ageing of coating solution (sensitivity at coating 4 hr. ageing–sensitivity at coating 30 min. ageing) |
|---|---|---|
| 514 | ±0 | −0.01 |
| 515 | ±0 | −0.01 |
| 516 | ±0 | −0.01 |
| 517 | 0.02 | −0.02 |
| 518 | 0.02 | −0.02 |
| 519 | 0.02 | −0.02 |
| 520 | 0.02 | −0.02 |
| 521 | 0.02 | −0.01 |
| 522 | 0.02 | −0.02 |
| 523 | 0.06 | −0.02 |
| 524 | 0.05 | −0.02 |
| 525 | 0.06 | −0.02 |
| 526 | 0.05 | −0.01 |
| 527 | 0.06 | −0.02 |
| 528 | 0.06 | −0.02 |
| 529 | 0.06 | −0.02 |
| 530 | ±0 | −0.01 |
| 531 | ±0 | −0.01 |
| 532 | ±0 | −0.01 |
| 533 | ±0 | −0.01 |
| 534 | ±0 | −0.01 |
| 535 | ±0 | −0.01 |
| 536 | ±0 | −0.01 |
| 537 | ±0 | −0.01 |
| 538 | ±0 | −0.01 |
| 539 | ±0 | −0.01 |
| 540 | ±0 | −0.01 |

(Note: Specimens 101, 508 to 522, and 530 to 540 are according to the present invention)

Combined with the results of Example 1, the aforementioned results show that only the combination according to the present invention can provide an excellent dependence on exposure temperature and a reduced desensitization due to the ageing of the coating solution.

Further, the use of a compound represented by the general formula (A) as a sensitizing dye provides remarkable improvements in these effects.

Thus, the present invention provides a silver halide color photographic material which has an excellent capability of being rapidly processed, exhibits a small sensitivity change with the fluctuations of the temperature upon exposure (dependence on the exposure temperature) and a small change in sensitivity and gradation with ageing time of the coating solution.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising at least one yellow-developable silver halide emulsion layer, at least one magenta-developable silver halide emulsion layer and at least one cyan-developable silver halide emulsion layer on a support, wherein said at least one cyan-developable silver halide emulsion layer comprises at least one cyan dye-forming coupler represented by the following formula (IIIa) and silver bromocholoride or silver chloride emulsion grains substantially free of silver iodide having a silver chloride content of 95 mol % or more spectrally sensitized with at least one sensitizing dye having a reduction potential of −1.27 V or lower:

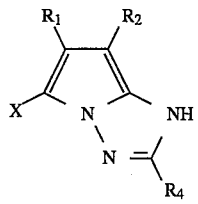

(IIIa)

$R_1$ is a cyano group and $R_2$ is any of a trifluoromethyl group, a straight-chain or branched unsubstituted alkoxycarbonyl group, an alkoxycarbonyl group substituted with a carbamoyl group, an alkoxycarbonyl group having an ether bond, and an aryloxycarbonyl group that is either unsubstituted or substituted with an alkyl group or an alkoxy group; $R_4$ represents a hydrogen atom or substituent; X represents a hydrogen atom or a split-off group from the rest of the structure upon coupling reaction with an oxidation product of an aromatic primary amine color developing agent; and $R_1$, $R_2$, $R_4$ or X may be a divalent group which is connected to a dimer or higher polymer or a high molecular chain to form a homopolymer or copolymer.

2. The silver halide color photographic material according to claim 1, wherein said at least one sensitizing dye to be used in said cyan-developable silver halide emulsion layer is selected from the group consisting of red-sensitive sensitizing dyes represented by the formulae (A), (B), (C) and (D):

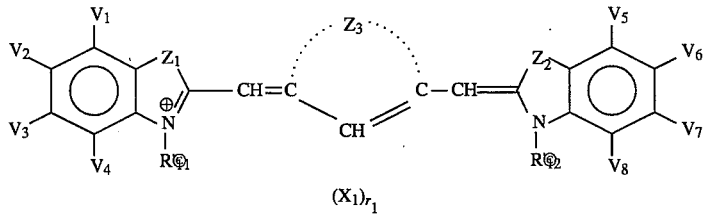

(A)

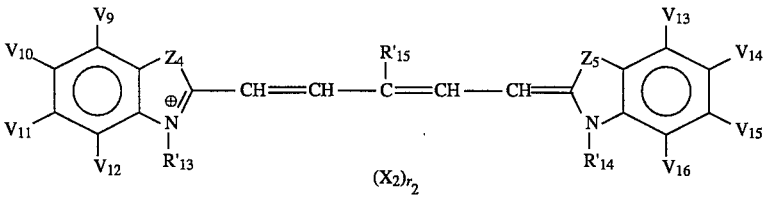

(B)

-continued

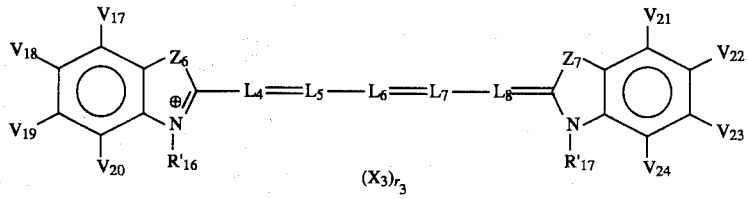

(C)

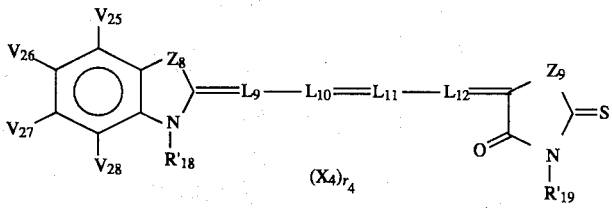

(D)

wherein $Z_1$, $Z_2$, $Z_4$ and $Z_5$ each represents a sulfur atom or selenium atom; $Z_6$ and $Z_7$ each represents an oxygen atom, sulfur atom, selenium atom or a substituted nitrogen atom, R—N, in which R has the same meaning as $R'_{19}$ defined below, with the proviso that at least one of $Z_6$ and $Z_7$ represents an oxygen atom or nitrogen atom; $Z_8$ represents an oxygen atom, sulfur atom, selenium atom or substituted nitrogen atom, R'—N, in which R' has the same meaning as $R'_{19}$; $Z_9$ represents an oxygen atom, sulfur atom or substituted nitrogen atom, R"—N, in which R" has the same meaning as $R'_{19}$; $Z_3$ represents an atomic group necessary for the formation of a 5- or 6-membered ring; $R'_{11}$, $R'_{12}$, $R'_{13}$, $R'_{14}$, $R'_{16}$, $R'_{17}$ and $R'_{18}$, which may be the same or different, each represents an alkyl group; $R'_{16}$ and $L_4$, and/or $R'_{17}$ and $L_8$, and/or $R'_{18}$ and $L_9$ may be connected to each other to form a 5- or 6-membered carbon ring; $R'_{19}$ represents an alkyl group, aryl group or heterocyclic group; $R'_{15}$ represents an alkyl group or alkoxy group; $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$, $V_{22}$, $V_{23}$, $V_{24}$, $V_{25}$, $V_{26}$, $V_{27}$ and $V_{28}$ each represents a hydrogen atom, halogen atom, alkyl group, acyl group, acyloxy group, alkoxycarbonyl group, carbamoyl group, sulfamoyl group, carboxyl group, cyano group, hydroxyl group, amino group, acylamino group, alkoxy group, alkylthio group, alkylsulfonyl group, sulfonic group, aryloxy group or aryl group; two of $V_{17}$ to $V_{28}$ which are connected to adjacent carbon atoms may together form a condensed ring, with the proviso that, when $Y_1=\sigma p_1+\sigma p_2+\sigma p_3+\sigma p_4+\sigma p_5+\sigma p_6+\sigma p_7+\sigma p_8$, wherein $\sigma p_i$ (i=1 to 8) is the Hammett's substituent constant value of $V_1$ to $V_8$, $Y_1$ is −0.15 or less and that, when $Y_2=\sigma p_9+\sigma p_{10}+\sigma p_{11}+\sigma p_{12}+\sigma p_{13}+\sigma p_{14}+\sigma p_{15}+\sigma p_{16}$, wherein $\sigma p_i$ (i=9 to 16) is the Hammett's substituent constant value of $V_9$ to $V_{16}$, $Y_2$ is −0.30 or less; $L_4$, $L_5$, $L_6$, $L_7$, $L_8$, $L_9$, $L_{10}$, $L_{11}$ and $L_{12}$ each represents a methine group; two of these methine groups may together form a ring; $(X_1)_{r1}$, $(X_2)_{r2}$, $(X_3)_{r3}$ and $(X_4)_{r4}$ each represents a charge balanced paired ion; and $r_1$, $r_2$, $r_3$ and $r_4$ each represents a value necessary for the neutralization of charge of 0 or more.

3. The silver halide photographic material of claim 2, wherein $R'_{11}$, $R'_{12}$, $R'_{13}$, $R'_{14}$, $R'_{16}$, $R'_{17}$ and $R'_{18}$ are alkyl groups containing 18 or less carbon atoms.

4. The silver halide photographic material of claim 3, wherein $R'_{11}$, $R'_{12}$, $R'_{13}$, $R'_{14}$, $R'_{16}$, $R'_{17}$ and $R'_{18}$ are selected from the group consisting of methyl, ethyl, 2-sulfoethyl, 3-sulfopropyl and 4-sulfobutyl groups.

5. The silver halide photographic material of claim 2, wherein $R'_{19}$ is selected from the group consisting of $C_{1-18}$ alkyl, aralkyl, hydroxyalkyl, carboxyalkyl, alkoxyalkyl, sulfoalkyl, sulfatoalkyl, heterocyclic-substituted alkyl, aryl and heterocyclic groups.

6. The silver halide photographic material of claim 2, wherein $R'_{15}$ is selected from the group consisting of $C_{1-3}$ alkyl, $C_{1-4}$ alkoxyalkyl and $C_{1-3}$ alkoxy groups.

7. The silver halide photographic material of claim 2, wherein $Z_3$ is 2,2-diemthyltrimethylene.

8. The silver halide photographic material of claim 2, wherein $Z_1$, $Z_2$, $Z_4$ and $Z_5$ each is a sulfur atom.

9. The silver halide photographic material of claim 2, wherein $Z_6$ and $Z_7$ each is a sulfur atom or an oxygen atom, and at least one of $Z_5$ and $Z_7$ is an oxygen atom.

10. The silver halide photographic material of claim 2, wherein $Z_8$ is a sulfur atom.

11. The silver halide photographic material of claim 2, wherein $Z_9$ is a sulfur atom.

12. The silver halide photographic material of claim 2, wherein $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$, $V_{22}$, $V_{23}$, $V_{24}$, $V_{25}$, $V_{26}$, $V_{27}$ and $V_{28}$ are selected from the group consisting of hydrogen atom, halogen atom, alkyl group having 18 or less carbon atoms, acyl group having 10 or less carbon atoms, acyloxy group having 10 or less carbon atoms, alkoxycarbonyl group having 10 or less carbon atoms, carbamoyl group, sulfamoyl group, carboxy group, cyano group, hydroxyl group, amino group, acylamino group having 8 or less carbon atoms, alkoxy group having 10 or less carbon atoms, alkylthio group, alkylsulfonyl group, sulfonic group, aryloxy group and aryl group, and two of $V_{17}$ to $V_{28}$ which are connected to adjacent carbon atoms are connected to each other to form a condensed ring which is selected from the group consisting of pyrrole, thiophene, furan, pyridine, imidazole, triazole and thiazole with the proviso that $Y_1=\sigma p_1+\sigma p_2+\sigma p_3+\sigma p_4+\sigma p_5+\sigma p_6+\sigma p_7+\sigma p_8$, wherein $\sigma p_1$ (i=1 to 8) is the Hammett's substituent constant value of $V_1$ to $V_8$, $Y_1$ is −0.30 or less and that $Y_2=\sigma p_9+\sigma p_{10}+\sigma p_{11}+\sigma p_{12}+\sigma p_{13}+\sigma p_{14}+\sigma p_{15}+\sigma p_{16}$, wherein $\sigma p_i$ (i=9 to 16) is the Hammett's substituent constant value of $V_9$ to $V_6$, $Y_2$ is −0.45 or less.

13. The silver halide photographic material of claim 12, wherein the alkyl groups for $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$, $V_{22}$, $V_{23}$, $V_{24}$, $V_{25}$, $V_{26}$, $V_{27}$ and $V_{28}$ are unsubstituted alkyl groups having 10 or less carbon atoms.

14. The silver halide photographic material of claim 12, wherein the alkyl groups for $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$, $V_{22}$, $V_{23}$, $V_{24}$, $V_{25}$, $V_{26}$, $V_{27}$ and $V_{28}$ are alkyl groups having 18 or less carbon atoms selected from the group consisting of benzoyl, α-naphthylmethyl, 2-phenylethyl and trifluoromethyl.

15. The silver halide photographic material of claim 12, wherein the sulfamoyl groups for $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$, $V_{22}$, $V_{23}$, $V_{24}$, $V_{25}$, $V_{26}$, $V_{27}$ and $V_{28}$ are sulfamoyl groups selected from the group consisting of sulfamoyl, N, N-dimethylsulfamoyl, morpholinosulfamoyl and piperidinosulfamoyl.

16. The silver halide photographic material of claim 12, wherein the alkyl groups for $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$, $V_{22}$, $V_{23}$, $V_{24}$, $V_{25}$, $V_{26}$, $V_{27}$ and $V_{28}$ are substituted alkyl groups having 18 or less carbon atoms wherein the substituents are selected from the group consisting of phenyl, naphthyl and fluorine.

17. The silver halide photographic material of claim 12, wherein the carbamoyl groups for $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$, $V_{22}$, $V_{23}$, $V_{24}$, $V_{25}$, $V_{26}$, $V_{27}$ and $V_{28}$ are selected from the group consisting of carbamoyl, N, N-dimethylcarbamoyl, morpholinocarbonyl and piperidinocarbonyl.

18. The silver halide photographic material of claim 12, wherein the alkyl groups for $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, and $V_{16}$, are carboxymethyl, 2-carboxyethyl, benzyl, phenethyl, and dimethylaminopropyl.

19. The silver halide photographic material of claim 2, wherein said red-sensitive sensitizing dyes are added in the range of $1\times10^{-6}$ to $1\times10^{-3}$ mol per mol of silver halide.

20. The silver halide photographic material of claim 2, wherein $R'_{11}$, $R'_{12}$, $R'_{13}$, $R'_{14}$, $R'_{16}$, $R'_{17}$ and $R'_{18}$ are substituted alkyl groups containing 18 or less carbon atoms wherein the substituents are selected from the group consisting of a carboxy group, a sulfo group, a cyano group, and a halogen atom.

21. The silver halide color photographic material according to claim 1, wherein said silver halide emulsion containing said silver bromochloride and/or silver chloride grains to be incorporated in said at least one cyan-developable silver halide emulsion layer is gold-sensitized.

22. The silver halide color photographic material of claim 1, wherein $R_4$ represents hydrogen, halogen, aliphatic, aryl, heterocyclic, alkoxy, aryloxy, heterocyclic oxy, alkylthio, arylthio, heterocyclic thio, acyloxy, carbamoyloxy, silyloxy, sulfonyloxy, acylamino, alkylamino, arylamino, ureido, sulfamoylamino, alkenyloxy, formyl, alkylacyl, arylacyl, heterocyclic acryl, alkylsulfonyl, arylsulfonyl, heterocyclic sulfonyl, alkylsulfinyl, arylsulfinyl, heterocyclic sulfinyl, alkoxycarbonyl, aryloxycarbonyl, heterocyclic oxycarbonyl, alkoxycarbonylamino, aryloxycarbonylamino, heterocyclic oxycarbonylamino, sulfonamide, carbamoyl, sulfamoyl, phosphonyl, sulfamide, imido, azoyl, hydroxyl, cyano, carboxyl, nitro, sulfo, or amino group.

23. The silver halide color photographic material of claim 1, wherein X represents hydrogen atom; halogen atom; aromatic azo group; alkyl, aryl, heterocyclic, alkylsulfonyl, arylsulfonyl, arylsulfinyl, alkoxycarbonyl, aryloxycarbonyl, heterocyclic oxycarbonyl, alkylcarbonyl, arylcarbonyl, heterocyclic carbonyl, alkylaminocarbonyl, arylaminocarbonyl or heterocyclic aminocarbonyl group connected to the coupling position via oxygen, nitrogen, sulfur or carbon atom; or heterocyclic group connected to the coupling position via a nitrogen atom contained therein.

24. The silver halide photographic material of claim 23, wherein X is arylthio.

25. The silver halide photographic material of claim 1, wherein said formula (IIIa) coupler is incorporated in a red-sensitive silver halide emulsion layer at a concentration of $1\times10^{-3}$ mole to 1 mole per mole of silver halide.

26. The silver halide photographic material of claim 25, wherein said formula (IIIa) coupler is present at a concentration of $2\times10^{-3}$ mole to $5\times10^{-1}$ mole per mole of silver halide.

* * * * *